US012331408B2

(12) United States Patent
Shimizu et al.

(10) Patent No.: US 12,331,408 B2
(45) Date of Patent: Jun. 17, 2025

(54) SURFACE-TREATED STEEL SHEET

(71) Applicant: NIPPON STEEL CORPORATION, Tokyo (JP)

(72) Inventors: Atsuo Shimizu, Tokyo (JP); Yoshikatsu Nishida, Tokyo (JP); Shin Ueno, Tokyo (JP); Hiromasa Shoji, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 18/841,582

(22) PCT Filed: Sep. 28, 2022

(86) PCT No.: PCT/JP2022/036111
§ 371 (c)(1),
(2) Date: Aug. 26, 2024

(87) PCT Pub. No.: WO2023/166772
PCT Pub. Date: Sep. 7, 2023

(65) Prior Publication Data

US 2025/0109500 A1 Apr. 3, 2025

(30) Foreign Application Priority Data

Mar. 3, 2022 (JP) ..... 2022-032606

(51) Int. Cl.
*C23C 28/00* (2006.01)
*C21D 9/46* (2006.01)
(Continued)

(52) U.S. Cl.
CPC ..... *C23C 28/32* (2013.01); *C21D 9/46* (2013.01); *C23C 2/06* (2013.01); *C23C 2/29* (2022.08); *C23C 22/36* (2013.01); *C23C 2222/20* (2013.01)

(58) Field of Classification Search
None
See application file for complete search history.

(56) References Cited

U.S. PATENT DOCUMENTS 6,878,462 B1 * 4/2005 Umino ..... C23C 28/023 428/626
2004/0256030 A1 * 12/2004 Tang ..... C23C 22/36 148/250
(Continued)

FOREIGN PATENT DOCUMENTS

JP 2007-23309 A 2/2007
JP 2007-51365 A 3/2007
(Continued)

OTHER PUBLICATIONS

Written Opinion of the International Searching Authority for PCT/JP2022/036111 (PCT/ISA/237) mailed on Dec. 13, 2022.

*Primary Examiner* — Seth Dumbris
(74) *Attorney, Agent, or Firm* — Birch, Stewart, Kolasch & Birch, LLP

(57) ABSTRACT

A surface-treated steel sheet includes: a base steel sheet; a plated layer formed on the base steel sheet and containing 50 mass % or more of Zn and 0.3 mass % or more of Mg; and a chemical conversion coating formed on the plated layer. The chemical conversion coating contains a silicon compound, P and F, and Mg, an average Si concentration of the chemical conversion coating is 10 mass % or more, the chemical conversion coating includes an F—Mg concentrated layer having an Mg concentration of 1.50 mass % or more and 40.00 mass % or less and an F concentration of 0.50 mass % or more and 5.00 mass % or less in a region in contact with an interface between the chemical conversion coating and the plated layer, a thickness of the F—Mg concentrated layer is 1.0 nm or more, and an average Mg concentration is less than 0.50 mass % and an average F
(Continued)

concentration is less than 0.50 mass % in a region of the chemical conversion coating excluding the F—Mg concentrated layer.

4 Claims, 1 Drawing Sheet

(51) Int. Cl.

| | |
|---|---|
| ***C23C 2/06*** | (2006.01) |
| ***C23C 2/28*** | (2006.01) |
| ***C23C 22/36*** | (2006.01) |

(56) References Cited

U.S. PATENT DOCUMENTS

| | | | | |
|---|---|---|---|---|
| 2009/0110921 | A1 | 4/2009 | Kaneto et al. | |
| 2017/0211188 | A1* | 7/2017 | Miura | C23C 22/44 |
| 2022/0145473 | A1 | 5/2022 | Shoji et al. | |

FOREIGN PATENT DOCUMENTS

| | | | | |
|---|---|---|---|---|
| JP | 4776458 | B2 | 9/2011 | |
| JP | 6070914 | B1 * | 2/2017 | C23C 2/06 |
| JP | 2021-42423 | A | 3/2021 | |
| WO | WO 2010/070728 | A1 | 6/2010 | |
| WO | WO 2020/189769 | A1 | 9/2020 | |

* cited by examiner

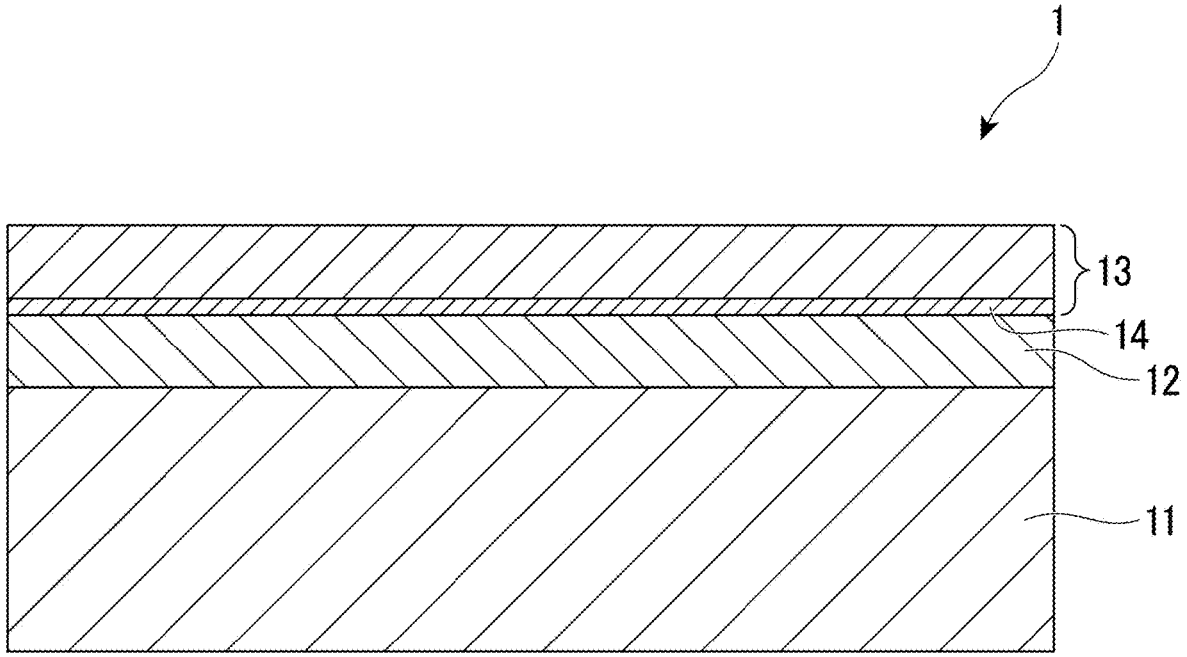
1
13
14
12
11

SURFACE-TREATED STEEL SHEET

TECHNICAL FIELD OF THE INVENTION

The present invention relates to a surface-treated steel sheet.

The present application claims priority based on Japanese Patent Application No. 2022-032606 filed in Japan on Mar. 3, 2022, the contents of which are incorporated herein by reference.

RELATED ART

Conventionally, a plated steel sheet (zinc-based plated steel sheet) in which a plated layer mainly composed of zinc is formed on a surface of a steel sheet has been used in a wide range of applications such as automobiles, building materials, and home electric appliances. Among them, particularly, a Mg-containing zinc-based plated steel sheet containing 0.5 mass % or more of Mg has high corrosion resistance due to the effect of Mg, and therefore has been used for applications such as building materials requiring particularly severe corrosion resistance.

In addition, in such applications, for the purpose of improving white rust resistance, a chromium-free chemical conversion treatment, for example, a chemical conversion treatment mainly including an organosilicon compound having a cyclic siloxane bond has been performed on the surface of a zinc-based plated steel sheet.

Patent Document 1 discloses a surface-treated steel obtained by (1) applying an aqueous metal surface treatment agent on a steel material surface and drying the aqueous metal surface treatment agent to form a composite film containing respective components, the aqueous metal surface treatment agent containing: (2) an organic silicon compound (W) obtained by blending a silane coupling agent (A) containing one amino group in a molecule and a silane coupling agent (B) containing one glycidyl group in a molecule in a solid content mass ratio [(A)/(B)] of 0.5 to 1.7, and containing, in a molecule, two or more functional groups (a) of a formula of —$SiR^1R^2R^3$ (in the formula, $R^1$, $R^2$, and $R^3$ independently represent an alkoxy group or a hydroxyl group, and at least one of $R^1$, $R^2$ and $R^3$ represents an alkoxy group) and one or more of at least one kind of hydrophilic functional group (b) selected from a hydroxy group (one separate from that able to be included in the functional group (a)) and an amino group, and having an average molecular weight of 1000 to 10000; (3) at least one kind of fluoro compound (X) selected from fluorotitanic acid and fluorozirconic acid; (4) phosphoric acid (Y); and (5) a vanadium compound (Z), and among the respective components of the composite film, (6) the solid content mass ratio [(X)/(W)] of the organic silicon compound (W) and fluoro compound (X) being 0.02 to 0.07, (7) the solid content mass ratio [(Y)/(W)] of the organic silicon compound (W) and phosphoric acid (Y) being 0.03 to 0.12, (8) the solid content mass ratio [(Z)/(W)] of the organic silicon compound (W) and vanadium compound (Z) being 0.05 to 0.17, and (9) the solid content mass ratio [(Z)/(X)] of the fluoro compound (X) and vanadium compound (Z) being 1.3 to 6.0.

Patent Document 1 discloses that the surface-treated steel satisfies all of corrosion resistance, heat resistance, fingerprint resistance, conductivity, coating properties, and black residue resistance during processing.

In addition, Patent Document 2 discloses a hot-dip zinc alloy-plated steel sheet having excellent corrosion resistance in which a chemical coating mainly composed of one or two or more of a hydroxide, an oxide, an oxyacid, an oxyacid salt, and a fluoride of a valve metal is formed on a Mg-containing zinc alloy-plated layer via an interface reaction layer containing one kind or two or more kinds selected from magnesium fluoride, magnesium phosphate, and a composite compound of magnesium and a valve metal oxyacid salt.

CITATION LIST

Patent Document

Patent Document 1: Japanese Patent No. 4776458

Patent Document 2: Japanese Unexamined Patent Application, First Publication No. 2007-23309

SUMMARY OF INVENTION

Problems to be Solved by the Invention

Even when the chemical conversion coating described in Patent Documents 1 and 2 is formed on the surface of the zinc-based plated layer, a certain degree of effect of improving white rust resistance can be obtained. However, as a result of studies by the present inventors, it has been found that in such a chemical conversion treatment, for example, when a steel material is placed in an environment in which the steel material comes into contact with flowing water in civil engineering and construction applications or in an environment in which dew condensation occurs, white rust may be generated early.

That is, an object of the present invention is to provide a surface-treated steel sheet capable of suppressing generation of white rust in both an environment in contact with flowing water and an environment in which dew condensation occurs on the premise that general characteristics such as blackening resistance are not deteriorated.

Means for Solving the Problem

The present inventors have studied a method for suppressing the generation of white rust in an environment where the steel sheet is in contact with flowing water and in an environment where dew condensation occurs on the premise of a Mg-containing zinc-based plated steel sheet subjected to a chemical conversion treatment mainly using an organosilicon compound. As a result, the present inventors have found that white rust resistance particularly in an environment in contact with flowing water (flowing water environment) can be improved by forming a layer in which F and Mg are concentrated in a region of the chemical conversion coating in contact with an interface between the plated layer and the chemical conversion coating.

In addition, as a result of further studies, it has been found that white rust resistance is improved even in an environment where dew condensation occurs (dew condensation environment) by forming a layer in which F and Mg are concentrated in the vicinity of the interface, and lowering the concentration of F in a region other than the layer in which F and Mg are concentrated.

The present invention has been made in view of the above findings. The gist of the present invention is as follows.

[1]A surface-treated steel sheet according to an aspect of the present invention includes: a base steel sheet; a plated layer formed on the base steel sheet and containing 50 mass % or more of Zn and 0.3 mass % or more of Mg; and a chemical conversion coating formed on the plated layer, in which the chemical conversion coating contains a silicon compound, P and F, and Mg, an average Si concentration of the chemical conversion coating is 10 mass % or more, the chemical conversion coating includes an F—Mg concentrated layer having an Mg concentration of 1.50 mass % or more and 40.00 mass % or less and an F concentration of 0.50 mass % or more and 5.00 mass % or less in a region in contact with an interface between the chemical conversion coating and the plated layer, a thickness of the F—Mg concentrated layer is 1.0 nm or more, and an average Mg concentration is less than 0.50 mass % and an average F concentration is less than 0.50 mass % in a region of the chemical conversion coating excluding the F—Mg concentrated layer.

[2] In the surface-treated steel sheet according to [1], the thickness of the F—Mg concentrated layer may be 5.0 nm or more and 100.0 nm or less in the chemical conversion coating.

[3] In the surface-treated steel sheet according to [1] or [2], a chemical composition of the plated layer may include, in terms of mass %, Al: 4.0% or more and less than 25.0%, Mg: 0.3% or more and less than 12.5%, Sn: 0% or more and 20% or less, Bi: 0% or more and less than 5.0%, In: 0% or more and less than 2.0%, Ca: 0% or more and 3.0% or less, Y: 0% or more and 0.5% or less, La: 0% or more and less than 0.5%, Ce: 0% or more and less than 0.5%, Si: 0% or more and less than 2.5%, Cr: 0% or more and less than 0.25%, Ti: 0% or more and less than 0.25%, Ni: 0% or more and less than 0.25%, Co: 0% or more and less than 0.25%, V: 0% or more and less than 0.25%, Nb: 0% or more and less than 0.25%, Cu: 0% or more and less than 0.25%, Mn: 0% or more and less than 0.25%, Fe: 0% or more and 5.0% or less, Sr: 0% or more and less than 0.5%, Sb: 0% or more and less than 0.5%, Pb: 0% or more and less than 0.5%, B: 0% or more and less than 0.5%, and the remainder: Zn and an impurity.

Effects of the Invention

According to the above-described aspect of the present invention, it is possible to provide a surface-treated steel sheet capable of suppressing generation of white rust in both an environment where the steel sheet is in contact with flowing water and an environment where dew condensation occurs.

BRIEF DESCRIPTION OF THE DRAWING

FIG. 1 is a schematic view illustrating an example of a cross section of a surface-treated steel sheet according to an embodiment.

EMBODIMENT(S) OF THE INVENTION

Hereinafter, a surface-treated steel sheet according to an embodiment of the present invention (surface-treated steel sheet according to the embodiment) will be described.

As shown in FIG. 1, a surface-treated steel sheet 1 according to the embodiment includes a base steel sheet 11, a plated layer 12 formed on the base steel sheet 11, and a chemical conversion coating 13 formed on the plated layer 12. In addition, the chemical conversion coating 13 has an F—Mg concentrated layer 14 in a region in contact with an interface between the chemical conversion coating 13 and the plated layer 12. In FIG. 1, the plated layer 12 and the chemical conversion coating (which may be simply referred to as a coating) 13 are formed only on one surface of the base steel sheet 11, but may be formed on both surfaces.

Hereinafter, the base steel sheet 11, the plated layer 12, and the chemical conversion coating 13 will be described.

<Base Steel Sheet>

In the surface-treated steel sheet 1 according to the embodiment, excellent corrosion resistance can be obtained by the plated layer 12 and the chemical conversion coating 13. The base steel sheet 11 is a steel material without the plated layer 12 or the chemical conversion coating 13 on a surface, and properties (strength, or the like), a sheet thickness, and the like are not particularly limited. The base steel sheet 11 may be determined by an applied product, required strength, a sheet thickness, and the like, and for example, a hot rolling soft steel sheet or a hot-rolled steel sheet described in JIS G3131:2018 or JIS G3113:2018, or a cold rolling steel sheet described in JIS G3141:2017 can be used.

<Plated Layer>

The plated layer 12 included in the surface-treated steel sheet 1 according to the embodiment is a plated layer (zinc-based plated layer) formed on a surface of the base steel sheet 11 and containing zinc (Zn) as a main component and Mg in an amount of 0.3 mass % or more. Here, description of containing Zn as a main component represents that the concentration (content) of Zn is 50 mass % or more. The Zn concentration (content) may be 55 mass % or more, 60 mass % or more, 65 mass % or more, 70 mass % or more, 75 mass % or more, or 80 mass % or more. The Zn concentration (content) is 99.7 mass % or less, but may be 95.7 mass % or less, 95 mass % or less, 92 mass % or less, 90 mass % or less, or 86 mass % or less.

Mg is an element necessary for forming an F—Mg concentrated layer on the chemical conversion coating after the chemical conversion treatment. When the Mg concentration (content) is less than 0.3 mass %, the F—Mg concentrated layer is not formed. Therefore, the Mg concentration is set to be 0.3 mass % or more.

In the plated layer 12, the concentration (content) of elements other than the above-described elements is not limited. However, when the chemical composition of the plated layer includes, in terms of mass %, Al: 4.0% or more and less than 25.0%, Mg: 0.3% or more and less than 12.5%, Sn: 0% or more and 20% or less, Bi: 0% or more and less than 5.0%, In: 0% or more and less than 2.0%, Ca: 0% or more and 3.0% or less, Y: 0% or more and 0.5% or less, La: 0% or more and less than 0.5%, Ce: 0% or more and less than 0.5%, Si: 0% or more and less than 2.5%, Cr: 0% or more and less than 0.25%, Ti: 0% or more and less than 0.25%, Ni: 0% or more and less than 0.25%, Co: 0% or more and less than 0.25%, V: 0% or more and less than 0.25%, Nb: 0% or more and less than 0.25%, Cu: 0% or more and less than 0.25%, Mn: 0% or more and less than 0.25%, Fe: 0% or more and 5.0% or less, Sr: 0% or more and less than 0.5%, Sb: 0% or more and less than 0.5%, Pb: 0% or more and less than 0.5%, B: 0% or more and less than 0.5%, and the remainder: Zn and an impurity, excellent corrosion resistance be obtained in a surface-treated steel sheet, and thus the chemical composition is preferable.

The reason for the preferred chemical composition of the plated layer 12 will be described. Unless otherwise specified, % related to the concentration (content) of each element in the chemical composition of the plated layer is mass %.

[Al: 4.0% or More and Less than 25.0%]

Al is an element effective for improving corrosion resistance in the zinc-based plated layer. For obtaining the above-described effect to a sufficient extent, the Al concentration is preferably 4.0% or more. The Al concentration may be 6.0% or more, 8.0% or more, 10.0% or more, or 13.0% or more.

On the other hand, when the Al concentration is 25.0% or more, the corrosion resistance of a cut end surface of the plated layer decreases. For this reason, the Al concentration is preferably less than 25.0%. The Al concentration may be 23.0% or less, 20.0% or less, 18.0% or less, or 15.0% or less.

[Mg: 0.3% or More and Less than 12.5%]

As described above, the Mg concentration is 0.3% or more for forming the F—Mg concentrated layer. In addition, Mg is an element having an effect of enhancing the corrosion resistance of the plated layer. When the effect of improving corrosion resistance is obtained, the Mg concentration is preferably 0.5% or more. The Mg concentration is more preferably 1.0% or more, still more preferably 2.0% or more or 3.0% or more. The Mg concentration may be 4.0% or more, 5.0% or more, 6.0% or more, or 8.0% or more.

On the other hand, a Mg concentration of 12.5% or more does not lead to further enhancement of the corrosion resistance improving effect, and may deteriorate the workability of the plated layer. In addition, there is a manufacturing-related problem such as an increase in amount of dross generated in a plating bath. For this reason, the Mg concentration is preferably less than 12.5%. The Al concentration may be 12.0% or less, 11.0% or less, 10.0% or less, or 9.0% or less.

The plated layer 12 may further contain the following elements as a chemical composition. It is not essential to contain the following elements, and the lower limit of these elements is 0%.

[Sn: 0% or More and 20% or Less]

[Bi: 0% or More and Less than 5.0%]

[In: 0% or More and Less than 2.0%]

These elements are elements that contribute to improvement of corrosion resistance and sacrificial corrosion resistance. Therefore, any one or more kinds of these may be contained. In a case of obtaining the above-described effect, the concentration is preferably 0.05% or more.

Among these, Sn is preferable because Sn is a low-melting-point metal and can be easily contained without impairing properties of the plating bath.

On the other hand, when the Sn concentration is more than 20%, the Bi concentration is 5.0% or more, or the In concentration is 2.0% or more, corrosion resistance decreases. For this reason, it is preferable that the Sn concentration is 20% or less, the Bi concentration is less than 5.0%, and the In concentration is less than 2.0%. The Sn concentration may be 15.0% or less, 10.0% or less, 5.0% or less, or 3.0% or less. The Bi concentration may be 4.0% or less, 3.0% or less, 2.0% or less, or 1.0% or less. The In concentration may be 1.5% or less, 1.0% or less, or 0.5% or less.

[Ca: 0% or More and 3.0% or Less]

Ca is an element that reduces the formation amount of dross that is likely to be formed during operation and contributes to improvement of plating manufacturability. Therefore, Ca may be contained. For obtaining this effect, the Ca concentration is preferably 0.1% or more.

On the other hand, when the Ca concentration is high, the corrosion resistance of a flat portion itself of the plated layer tends to be deteriorated, and the corrosion resistance of the periphery of the weld may also be deteriorated. For this reason, the Ca concentration is preferably 3.0% or less. The Bi concentration may be 2.0% or less, 1.0% or less, or 0.5% or less.

[Y: 0% or More and 0.5% or Less]

[La: 0% or More and Less than 0.5%]

[Ce: 0% or More and Less than 0.5%]

Y, La, and Ce are elements that contribute to improvement of corrosion resistance. In a case of obtaining this effect, it is preferable to contain each of one or more kinds thereof in an amount of 0.05% or more.

On the other hand, if the concentration of these elements becomes excessive, there is a concern that the viscosity of the plating bath increases, and thus it is difficult to initial make-up the plating bath, and a steel material having good plating properties cannot be manufactured. For this reason, it is preferable that the Y concentration is 0.5% or less, the La concentration is less than 0.5%, and the Ce concentration is less than 0.5%. The concentration of these elements may be 0.3% or less, 0.2% or less, or 0.1% or less.

[Si: 0% or More and Less than 2.5%]

Si is an element that contributes to improvement of corrosion resistance. In addition, Si is an element having an effect of enhancing adhesion between the steel sheet and the plated layer by suppressing a situation in which an alloy layer formed between a steel sheet surface and the plated layer in formation of the plated layer on the steel sheet has an excessively large thickness. For obtaining these effects, the Si concentration is preferably 0.1% or more. The Si concentration is more preferably 0.2% or more.

On the other hand, when the Si concentration is 2.5% or more, an excessive amount of Si precipitates in the plated layer, and thus corrosion resistance decreases and the workability of the plated layer deteriorates. Therefore, the Si concentration is preferably less than 2.5%. The Si concentration is more preferably 1.5% or less. The Si concentration may be 1.2% or less, 1.0% or less, 0.6% or less, or 0.3% or less.

[Cr: 0% or More and Less than 0.25%]

[Ti: 0% or More and Less than 0.25%]

[Ni: 0% or More and Less than 0.25%]

[Co: 0% or More and Less than 0.25%]

[V: 0% or More and Less than 0.25%]

[Nb: 0% or More and Less than 0.25%]

[Cu: 0% or More and Less than 0.25%]

[Mn: 0% or More and Less than 0.25%]

These elements contribute to improvement of corrosion resistance. For obtaining this effect, it is preferable that the concentration of one or more of the elements is 0.05% or more.

On the other hand, if the concentration of these elements becomes excessive, there is a concern that the viscosity of the plating bath increases, and thus it is difficult to initial make-up the plating bath, and a steel material having good plating properties cannot be manufactured. For this reason, the concentration of each of the elements is preferably less than 0.25%. The concentration of these elements may be 0.20% or less, 0.10% or less, or 0.05% or less.

[Fe: 0% or More and 5.0% or Less]

Fe is mixed into the plated layer as an impurity when the plated layer is manufactured. Fe may be contained up to approximately 5.0%, but as long as the content of Fe is in this range, there is little adverse effect on the effect of the surface-treated steel sheet according to the embodiment. For this reason, the Fe concentration is preferably 5.0% or less. The Fe concentration may be 3.0% or less, 2.0% or less, 1.0% or less, or 0.5% or less.

[Sr: 0% or More and Less than 0.5%]

[Sb: 0% or More and Less than 0.5%]

[Pb: 0% or More and Less than 0.5%]

When Sr, Sb, and Pb are contained in the plated layer, the external appearance of the plated layer changes, a spangle is formed, and improvement in metallic gloss is confirmed. To obtaining this effect, it is preferable that the concentration of one or more of Sr, Sb, and Pb is 0.05% or more.

On the other hand, if the concentration of these elements becomes excessive, there is a concern that the viscosity of the plating bath increases, and thus it is difficult to initial make-up the plating bath, and a steel material having good plating properties cannot be manufactured. For this reason, the concentration of each of the elements is preferably less than 0.5%. The concentration of these elements may be 0.4% or less, 0.2% or less, or 0.1% or less.

[B: 0% or More and Less than 0.5%]

B is an element that combines with Zn, Al, Mg, or the like when contained in the plated layer to form various intermetallic compounds. The intermetallic compounds have an effect of improving LME cracking resistance. For obtaining this effect, the B concentration is preferably 0.05% or more.

On the other hand, when the B concentration is excessively high, there is a concern that the melting point of plating significantly increases, and the operability of plating deteriorates, and thus a surface-treated steel sheet having good plating properties cannot be obtained. For this reason, the B concentration is preferably less than 0.5%. The B concentration may be 0.4% or less, 0.2% or less, or 0.1% or less.

The adhesion amount of the plated layer 12 is not limited, but is preferably 10 $g/m^2$ or more per one surface for improving corrosion resistance. The adhesion amount may be 20 $g/m^2$ or more, 35 $g/m^2$ or more, 50 $g/m^2$ or more, or 70 $g/m^2$ or more per one surface. On the other hand, even when the adhesion amount exceeds 200 $g/m^2$ per one surface, corrosion resistance is saturated and it is economically disadvantageous. Therefore, the adhesion amount per one surface is preferably 200 $g/m^2$ or less. The adhesion amount may be 175 $g/m^2$ or less, 150 $g/m^2$ or less, 125 $g/m^2$ or less, or 110 $g/m^2$ or less per one surface.

<Chemical Conversion Coating>

[The Chemical Conversion Coating Contains a Silicon Compound, P and F, and Mg, and has an Average Si Concentration of 10 Mass % or More]

The chemical conversion coating 13 included in the surface-treated steel sheet 1 according to the embodiment is obtained by applying a treatment solution containing a silane coupling agent, a fluoride, and a P compound such as a phosphate on a plated layer containing zinc under predetermined conditions and drying the treatment solution. Therefore, the chemical conversion coating 13 included in the surface-treated steel sheet 1 according to the embodiment contains a silicon compound containing Si, C, and O derived from the silane coupling agent as a film-forming component, and contains P derived from the P compound and F derived from the fluoride as inhibitor components. The chemical conversion coating 13 contains Mg derived from a Mg compound or the like. When the silicon compound is a film-forming component, an average Si concentration of the chemical conversion coating is 10 mass % or more. The average Si concentration may be 11 mass % or more, 12 mass % or more, 14 mass % or more, or 16 mass % or more. The upper limit of the average Si concentration is not limited, but the average Si concentration may be 35 mass % or less. The average Si concentration may be 30 mass % or less, 27 mass % or less, 24 mass % or less, 22 mass % or less, or 20 mass % or less.

The maximum value of the P concentration obtained by a measurement method described later is preferably 0.01 mass % or more, more preferably 0.02 mass % or more, 0.05 mass % or more, or 0.10 mass % or more. The average P concentration does not need to be particularly specified, but the average P concentration may be 0.01% or more, 0.05 mass % or more, 0.10 mass % or more, 0.20 mass % or more, 0.50 mass % or more, 0.80 mass % or more, or 1.20 mass % or more. The average P concentration may be 10.00 mass % or less, 7.00 mass % or less, 5.00 mass % or less, or 3.00 mass or less.

A maximum value of the F concentration obtained by a measurement method described later is preferably 0.01 mass % or more, 0.05 mass % or more, and more preferably 0.10 mass % or more. The average. F concentration does not need to be particularly specified, but the average F concentration may be 0.01 mass % or more, 0.05 mass % or more, 0.10 mass % or more, 0.15 mass % or more, or 0.20 mass % or more. The average F concentration may be 1.10 mass % or less, 1.00 mass % or less, 0.70 mass % or less, 0.50 mass % or less, 0.40 mass % or less, or 0.35 mass % or less.

The maximum value of the Mg concentration obtained by a measurement method described later is preferably 0.05 mass % or more, and more preferably 0.10 mass % or more. The average Mg concentration does not need to be particularly specified, but the average Mg concentration may be 0.01 mass % or more, 0.05 mass % or more, 0.10 mass % or more, 0.15 mass % or more, or 0.20 mass % or more. The average Mg concentration may be 1.00 mass % or less, 0.70 mass % or less, 0.50 mass % or less, 0.40 mass % or less, or 0.35 mass % or less.

If necessary, the chemical conversion coating 13 may contain Zr or V derived from a Zr compound or a V compound. The amounts of Zr and V derived from the Zr compound and the V compound are any contents, and the lower limit of the average Zr concentration and the average V concentration is 0%. The average Zr concentration and the average V concentration may be 3.00 mass % or less, 2.00 mass % or less, 1.00 mass % or less, 0.70 mass % or less, or 0.50 mass % or less, respectively.

Whether or not the chemical conversion coating contains P, F, Mg, Z, and V, and the average Si concentration in the chemical conversion coating are determined by the following method.

A sample having a size that can be inserted into a cryoFIB processing device is cut out from the surface-treated steel on which the chemical conversion coating is formed, a test piece having a thickness of 80 to 200 nm is cut out from the sample by a cryoFIB (focused ion beam) method, and a cross-sectional structure of the cut test piece is observed with a transmission electron microscope (TEM) at a magnification at which the entire chemical conversion coating enters an observed visual field. In order to specify constituent elements of each layer, quantitative analysis of Si, P, F, Mg, Zr, and V is performed at five or more points in the coating using TEM-EDS (Energy Dispersive X-ray Spectroscopy). The average value of the Si concentration at each point is adopted as the average Si concentration of the chemical conversion coating. On the other hand, with respect to P, F, Mg, Zr, and V, when even one of the points is detected (when a value exceeding the detection limit (for example, the concentration is 0.001 mass % or more or 0.005 mass % or more.) is obtained), it is determined that P, F, Mg, Zr, and V are contained in the coating film. However, a device having a detection limit value of at least P, F, Mg, Zr, and V is 0.01 mass % or less is used. That is, when there is even one measurement point at which the content is 0.01 mass % or more, it is determined that the element is contained.

Whether or not the chemical conversion coating contains a silicon compound (whether or not Si is present as a silicon compound) can be confirmed by using FT-IR.

Specifically, when a peak of absorbance at 1030 to 1200 $cm^{1}$ showing a siloxane bond is observed by using a general FT-IR apparatus, it is determined that the silicon compound is contained. As the FT-IR device, for example, a model number: Frontier IR manufactured by PERKIN ELMER can be used.

In the FT-IR, for example, measurement conditions are as follows.

Measurement method: diffuse reflection method

Resolution: 4 $cm^{1}$

Number of scans: 128 times

Measurement atmosphere: the air

[F—Mg Concentrated Layer Having a Mg Concentration of 1.50 Mass % or More and 40.00 Mass % or Less and an F Concentration of 0.50 Mass % or More and 5.00 Mass % or Less in a Region in Contact with an Interface Between the Coating and the Plated Layer is Provided]

The present inventors have studied a method for suppressing the generation of white rust in an environment where the steel sheet is in contact with flowing water and in an environment where dew condensation occurs on the premise of a Mg-containing zinc-based plated steel sheet subjected to a chemical conversion treatment mainly using an organosilicon compound. As a result, the present inventors have found that white rust resistance in an environment in contact with flowing water (flowing water environment) can be improved by forming a layer (F—Mg concentrated layer) having an Mg concentration of 1.50 mass % or more and 40.00 mass % or less and an F concentration of 0.50 mass % or more and 5.00 mass % or less in a region of the chemical conversion coating in contact with an interface between the plated layer and the chemical conversion coating.

The mechanism of improving the white rust resistance by the F—Mg concentrated layer is not clear, but it is considered that the F—Mg concentrated layer in which F and Mg are concentrated is an amorphous layer containing a Mg—F composite salt, and it is considered that the white rust resistance is improved by the amorphous layer having a high barrier property.

In the related art, it has been shown that a Zn—F composite salt or an Al—F composite salt is formed near an interface. However, as a result of examination by the present inventors, as a result of observing a test piece after a corrosion resistance test in a flowing water environment with a transmission electron microscope (TEM), disappearance of the Zn—F composite salt and the Al—F composite salt was confirmed. On the other hand, the Mg—F composite salt remained even after the corrosion resistance test in a flowing water environment. That is, in the Mg—F composite salt, the layer is maintained for a long period of time as compared with the Zn—F composite salt or the Al—F composite salt even in a flowing water environment, that is, the barrier effect is maintained. Therefore, when the F—Mg concentrated layer is not formed, it is considered that the improvement of white rust resistance in a flowing water environment is not sufficient.

When a layer is a layer having a Mg concentration of less than 1.50 mass % or a Mg concentration of less than 0.50 mass %, the above-described effect cannot be obtained.

In addition, even when F and Mg are concentrated, blackening resistance is reduced when a layer is a layer having a Mg concentration of more than 40.0 mass % or an F concentration of more than 5.00 mass %.

Therefore, in the embodiment, a layer having a Mg concentration of 1.50 mass % or more and 40.00 mass % or less and an F concentration of 0.50 mass % or more and 5.00 mass % or less is defined as the F—Mg concentrated layer.

In the embodiment, in a case where an F—Mg concentrated layer is provided, this case represents that an average thickness is 1.0 nm or more when the thicknesses of the F—Mg concentrated layer at 10 locations is measured in the measurement method described later.

The thickness of the F—Mg concentrated layer (the thickness from the interface between the plated layer and the chemical conversion coating) is preferably 5.0 nm or more and 100.0 nm or less on average.

When the thickness of the F—Mg concentrated layer is 5.0 nm or more, the white rust resistance is remarkably improved. Therefore, the thickness of the F—Mg concentrated layer is preferably 1.5 nm or more, 2.0 nm or more, 3.0 nm or more, or 5.0 nm or more, and more preferably 10.0 nm or more, 20.0 nm or more, 40.0 nm or more, or 60.0 nm or more.

On the other hand, since the F—Mg concentrated layer is hard, when the thickness of the F—Mg concentrated layer is large, the amorphous layer serves as a starting point when the surface-treated steel sheet is worked, and the chemical conversion coating may be peeled off. In this case, the worked portion corrosion resistance may be reduced. Therefore, from the viewpoint of suppressing coating peeling of the worked portion, the thickness of the F—Mg concentrated layer is preferably 200.0 nm or less, 150.0 nm or less, or 120.0 nm or less. In a case of obtaining more excellent worked portion corrosion resistance, the thickness of the F—Mg concentrated layer is preferably 100.0 nm or less.

[The Average Mg Concentration is Less than 0.50 Mass %, and the Average F Concentration is Less than 0.50 Mass % in a Region Excluding the F—Mg Concentrated Layer]

In the surface-treated steel sheet 1 according to the embodiment, blackening resistance is reduced when the average Mg concentration is 0.50 mass % or more in the region excluding the F—Mg concentrated layer. Therefore, in order to ensure sufficient (equal to or greater than conventional) blackening resistance, the Mg concentration in the region excluding the F—Mg concentrated layer is set to be less than 0.50 mass %. The Mg concentration in the region excluding the F—Mg concentrated layer may be set to be 0.45 mass % or less, 0.40 mass % or less, or 0.35 mass % or less as necessary.

As a result of examination by the present inventors, it has been found that in the surface-treated steel sheet 1 according to the embodiment, when the average F concentration is 0.50 mass % or more in the region excluding the F—Mg concentrated layer, white rust resistance in an environment where dew condensation occurs deteriorates. Therefore, in the surface-treated steel sheet 1 according to the embodiment, the average F concentration is set to be less than 0.50 mass % in the region excluding the F—Mg concentrated layer. The F concentration in the region excluding the F—Mg concentrated layer may be set to be 0.45 mass % or less, 0.40 mass % or less, or 0.35 mass % or less as necessary.

The thickness of the F—Mg concentrated layer (the thickness from the interface between the plated layer and the chemical conversion coating) is determined by the following method.

A sample having a size that can be inserted into a cryoFIB processing device is cut out from the surface-treated steel on which the chemical conversion coating is formed, a test piece having a thickness of 80 to 200 nm is cut out from the sample by a cryoFIB (focused ion beam) method, and a cross-sectional structure of the cut test piece is observed with a transmission electron microscope (TEM) at a magnification at which the entire chemical conversion coating enters an observed visual field.

Based on the observation image, the interface between the plated layer and the chemical conversion coating (chemical conversion treatment layer) is visually determined, and line analysis is performed in parallel with a thickness direction of the plated layer to measure the concentrations of F and Mg. At that time, a start point of the analysis is a position of 100 nm on a steel sheet side from the interface between the plated layer and the chemical conversion coating, and an end point is a surface of the chemical conversion coating. A measurement pitch of the line analysis is set to be 1.0 nm.

As a result of the measurement, a range in which the Mg concentration is 1.50 mass % or more and 40.00 mass % or less and the F concentration is 0.50 mass % or more and 5.00 mass % or less is determined as the F—Mg concentrated layer, and this thickness is set as the thickness of the F—Mg concentrated layer. However, the measurement is performed at 10 points at intervals of 100 nm in a direction orthogonal to the thickness direction from any point, and the average thereof is set as the thickness of the F—Mg concentrated layer.

The average Mg concentration and the average F concentration in the region excluding the F—Mg concentrated layer are determined by the following method.

In the measurement of the thickness of the F—Mg concentrated layer, a point farthest from the interface between the plated layer and the chemical conversion coating in the F—Mg concentrated layer (the F—Mg concentrated layer is a part of the chemical conversion coating, and is formed in a portion adjacent to the plated layer in the chemical conversion coating. Therefore, the point farthest from the interface between the plated layer and the chemical conversion coating in the F—Mg concentrated layer is the point closest to the surface of the chemical conversion coating in the F—Mg concentrated layer) is set as the starting point, and at a pitch of 1.0 nm up to the surface of the chemical conversion coating, line analysis is performed to measure the Mg concentration and the F concentration, and the average values thereof are set as an average Mg concentration and an average F concentration, respectively.

The thickness of the chemical conversion coating 13 including the F—Mg concentrated layer is preferably 0.02 to 2.0 μm, and more preferably 0.2 to 2.0 μm. Since a boundary between the plated layer and the chemical conversion coating can be easily identified from a difference in contrast during the TEM observation, the thickness of the chemical conversion coating is determined by measuring a distance from the boundary to the surface of the chemical conversion coating. In the measurement, the measurement is performed at 10 points at intervals of 100 nm in a direction orthogonal to the thickness direction from any point, and the average of the measurement results is set as the thickness of the chemical conversion coating.

<Manufacturing Method>

Next, a preferred manufacturing method for the surface-treated steel sheet according to the embodiment will be described.

The surface-treated steel sheet according to the embodiment can obtain the effect as long as the above-described characteristics are provided regardless of the manufacturing method, but the following manufacturing method is preferable because stable manufacturing is possible.

That is, the surface-treated steel sheet according to the embodiment can be manufactured by a manufacturing method including the following steps.

(I) a plating step of forming a plated layer on a surface of a steel sheet by immersing the steel sheet in a plating bath containing Zn and Mg, pulling up the steel sheet, and cooling the steel sheet with water, (II) an application step of applying a chemical conversion treatment solution containing a silane coupling agent, a fluoride, acetylacetone (acetylacetonate), a P compound, and Mg to the steel sheet including the plated layer, (III) a heating step of heating the steel sheet applied with the chemical conversion treatment solution to form a coating (chemical conversion coating) containing a silicon compound, P, F, and Mg.

Hereinafter, preferred conditions for each step will be described.

[Plating Step]

In the plating step, the steel sheet is immersed in a plating bath containing Zn and Mg, pulled up, and cooled with water to form a plated layer on the surface.

In the related art, as the Mg-containing zinc-based plated layer, those having a Mg concentration of less than 10 mass % on the plated surface have been used. On the other hand, in the embodiment, the Mg concentration of the plating surface at a stage of being subjected to a chemical conversion treatment is 20 mass % or more. When the Mg concentration of the plating surface is set to be 20 mass % or more, supply of Mg to an interface is promoted. In this case, the F—Mg concentrated layer can be formed in the chemical conversion coating by applying and heating a predetermined chemical conversion treatment solution as described later.

On the other hand, when the Mg concentration of the plating surface is more than 60 mass %, the Mg concentration of the layer formed at the interface becomes excessive. Therefore, the Mg concentration of the plating surface is set to be 60 mass % or less.

The Mg concentration of the plating surface after the plating step (before the chemical conversion treatment) can be controlled by water cooling conditions after the steel sheet is pulled up from the plating bath. Specifically, at the time of water cooling, by adjusting a pH of the cooling water to 9.5 or more and controlling the temperature of the steel sheet immediately before the steel sheet comes into contact with the cooling water to 170° C. or lower, the Mg concentration of the plating surface can be set to be 20 mass % or more and 60 mass % or less.

The reason why the Mg concentration of the plating surface can be adjusted by controlling the water-cooling condition will be described. In the Mg-containing zinc-based plated steel sheet, immediately after solidification of the plated layer, Mg having high affinity with oxygen is concentrated on the surface layer of the plated layer at a thickness of approximately several nm. However, Mg is extremely unstable and is easily dissolved in water in water cooling after plating, and the Mg concentration on the surface is equivalent to the Mg concentration in the plated layer. On the other hand, by performing water cooling while controlling to the above-described range, elution of Mg is suppressed, and the Mg concentration on the surface of the plated layer can be set to be 20 to 60 mass %.

Although the mechanism in which the elution of Mg is suppressed is not clear, it is considered that when adjusting the pH to 9.5 or more, Mg approaches a passivation region, and a reaction between Mg and water is suppressed due to a low steel sheet temperature. When the pH is less than 9.5, the Mg concentration of the plating surface is less than 20 mass %. When the steel sheet temperature immediately before the steel sheet comes into contact with the cooling water exceeds 170° C., the Mg concentration of the plating surface is less than 20 mass %.

On the other hand, when the pH exceeds 11.0, an external appearance of the plated layer deteriorates. In this case, since the external appearance after formation of the chemical conversion coating also deteriorates, the pH is preferably 11.0 or less.

After the plating step and before the chemical conversion treatment, the thickness of the Mg concentrated layer having a Mg concentration of 20 mass % or more and 60 mass % or less is preferably 3.0 to 100 nm. When setting the thickness of the Mg concentrated layer to 3.0 to 100 nm, it is advantageous to set the thickness of the F—Mg concentrated layer after the chemical conversion treatment to 5.0 to 100.0 nm.

When the thickness of the Mg concentrated layer is set to be 3.0 to 100 nm, the temperature of the steel sheet immediately before contact with cooling water is preferably 120° C. or higher and 150° C. or lower.

The thickness of the Mg concentrated layer having a Mg concentration of 20 mass % or more and 60 mass % or less can be determined by the following method.

A sample having a size that can be inserted into a cryoFIB processing device is cut out from a plated steel sheet before the chemical conversion treatment, a test piece having a thickness of 80 to 200 nm is cut out from the sample by a cryoFIB (focused ion beam) method, and a cross-sectional structure of the cut out test piece is observed with a transmission electron microscope (TEM) at a magnification at which the entire plated layer enters an observed visual field in a thickness direction.

The interface between the plated layer and the base steel sheet is determined based on the observation image, and the concentration of Mg is measured by performing line analysis in parallel with the thickness direction of the plated layer. At that time, the start point of the analysis is a position of 100 nm from the interface between the plated layer and the steel sheet to a steel sheet side, and the end point is the surface of the plated layer. A measurement pitch of the line analysis is set to be 1 nm.

As a result of the measurement, a range in which the Mg concentration is 20 mass % or more and 60 mass % or less is determined as the Mg concentrated layer, and this thickness is set as the thickness of the Mg concentrated layer. However, the measurement is performed at 10 points at intervals of 100 nm in a direction orthogonal to the thickness direction from any point, and the average thereof is set as the thickness of the Mg concentrated layer.

In the measurement, when the thickness of the concentrated layer specified by TEM is 5 nm or less, it is preferable to use a TEM having a spherical aberration correction function from the viewpoint of spatial resolution.

The steel sheet to be subjected to the plating step and the method for manufacturing the steel sheet are not limited. As the steel sheet to be immersed in the plating bath, for example, a hot-rolled soft steel sheet or a hot rolling steel sheet described in JIS G3131:2018 or JIS G3113:2018, or a cold rolling steel sheet described in JIS G3141:2017 can be used.

The composition of the plating bath may be adjusted according to the chemical composition of the plated layer to be obtained.

After the steel sheet is pulled up from the plating bath, the adhesion amount of the plated layer can be adjusted by wiping.

Various known pH adjusting agents may be used for adjusting the pH of the cooling water.

[Application Step]

In an application step, a chemical conversion treatment solution is applied to the steel sheet (plated steel sheet) on which the plated layer is formed. As the chemical conversion treatment solution, a treatment solution containing a silane coupling agent, a fluoride, acetylacetone (acetylacetonate), a P compound, and a Mg compound may be used. The chemical conversion treatment solution may contain a Zr compound and a V compound.

In the application step, the method for applying the surface treatment metal agent is not limited. For example, the surface treatment metal agent can be applied using a roll coater, a bar coater, a spray, or the like.

The silane coupling agent is contained as a film-forming component. As the silane coupling agent, for example, a Si compound obtained by blending a silane coupling agent (A) containing one amino group in a molecule and a silane coupling agent (B) containing one glycidyl group in the molecule at a solid content concentration ratio (A)/(B) of 0.5 to 1.7 may also be used.

The phosphorus (P) compound contained in the chemical conversion treatment solution remains as P as an inhibitor component in the chemical conversion coating. The corrosion resistance of the chemical conversion coating is improved by P as the inhibitor component.

With regard to a blending amount of the P compound (T), a solid content mass ratio [(Ts)/(Ss)] of Si derived from the organosilicon compound (S) and P derived from the phosphorus compound (T) is preferably set to be 0.15 to 0.31. When the solid content mass ratio [(Ts)/(Ss)] of Si derived from the organosilicon compound (S) to P derived from the P compound (T) is less than 0.15, since the effect of the P compound (T) as an eluting inhibitor cannot be obtained, the ratio is not preferable. On the other hand, it is not preferable that [(Ts)/(Ss)] is more than 0.31 since the water solubility of the coating becomes significant.

In the embodiment, the P compound contained in the chemical conversion treatment solution is not particularly limited, and examples thereof include phosphoric acid, ammonium phosphate, potassium phosphate, and sodium phosphate. Among these, phosphoric acid is more preferable. When phosphoric acid is used, more excellent corrosion resistance can be obtained.

The fluoride in the chemical conversion treatment solution reacts with Mg in the plated layer to form an F—Mg concentrated layer. Therefore, when the surface-treated steel sheet according to the embodiment is obtained, the chemical conversion treatment solution contains a fluoride (fluorine compound).

With regard to the blending amount of the fluoride (U), in the blending amount of the fluoride contained in the chemical conversion treatment solution, a mass ratio [(Us)/(Xs)] between the solid content (X) contained in the chemical conversion treatment solution and F derived from the fluoride is preferably set to be 0.02 to 0.70. When [(Us)/(Xs)] is less than 0.02, the F concentration in the vicinity of the interface is less than 0.5 mass %, and there is a concern that a predetermined F—Mg layer is not formed. On the other hand, when [(Us)/(Xs)] exceeds 0.70, there is a concern that the F concentration exceeds 0.50 mass % in a portion other than the F—Mg concentrated layer.

Examples of the fluoride contained in the chemical conversion treatment solution include compounds such as hydrofluoric acid HF, borofluoric acid $BF_4H$, hydrofluorosilicic acid $H_2SiF_6$, zirconium hydrofluoric acid $H_2ZrF_6$, titanium hydrofluoric acid $H_2TiF_6$, titanium ammonium fluoride $(NH_4)_2TiF_6$, and zirconium ammonium fluoride $(NH_4)_2ZrF_6$. The compound may be one type or a combination of two or more types. Among these, hydrofluoric acid is more preferable. When hydrofluoric acid is used, more excellent corrosion resistance and coatability can be obtained.

Mg contained in the chemical conversion treatment solution contributes to formation of the F—Mg concentrated layer. The reason for this is not clear, but it is estimated that Mg serves as a starting point for the formation of the F—Mg concentrated layer in the vicinity of the interface with the plated layer.

When the chemical conversion treatment solution does not contain Mg, even though the plated layer contains Mg, the F—Mg concentrated layer is not sufficiently formed at the interface, and a sufficient white rust resistance improving effect cannot be obtained.

Examples of the Mg compound contained in the chemical conversion treatment solution include magnesium fluoride, magnesium nitrate, magnesium sulfate, magnesium chloride, and magnesium acetate.

When Mg is contained in the chemical conversion treatment solution in a state of an Mg compound, the blending amount of the Mg compound contained in the chemical conversion treatment solution is preferably set such that the mass ratio [(Vs)/(Xs)] of the solid content (X) contained in the chemical conversion treatment solution and Mg of the Mg compound is 0.05 to 0.60. When [(Vs)/(Xs)] is less than 0.05, the F concentration in the vicinity of the interface is less than 0.5 mass %, and there is a concern that a predetermined F—Mg concentrated layer is not formed. On the other hand, when [(Vs)/(Xs)] exceeds 0.60, there is a concern that the Mg concentration exceeds 0.5 mass % in a portion other than the F—Mg concentrated layer.

Acetylacetone (acetylacetonate) contained in the chemical conversion treatment solution contributes to stabilization of the Mg compound, and suppresses a reaction of the Mg compound with components in the treatment solution during storage of the treatment solution. When acetylacetone is not contained in the chemical conversion treatment solution, a sufficient F—Mg concentrated layer is not formed.

With regard to the blending amount of the acetylacetone (W), the molar ratio [(Wmol)/(Vmol)] of the acetylacetone (W) to the Mg compound (V) is preferably 1.0 to 10.0. When the molar ratio [(Wmol)/(Vmol)] of the acetylacetone (W) to the Mg compound (V) is less than 1.0, the F concentration in the vicinity of the interface becomes less than 0.5 mass %, and there is a concern that a predetermined F—Mg concentrated layer is not formed. On the other hand, when [(Wmol)/(Vmol)] exceeds 10.0, the stabilizing action of the Mg compound is saturated, and the economic efficiency is poor.

When the chemical conversion treatment solution contains a Zr compound, examples of the Zr compound include ammonium zirconium carbonate, hexafluorozirconium hydroacid, and zirconium ammonium hexafluoride.

When the chemical conversion treatment solution contains a V compound, examples of the V compound include vanadium pentoxide $V_2O_5$, metavanadic acid $HVO_3$, ammonium metavanadate, sodium metavanadate, vanadium oxytrichloride $VOCl_3$, vanadium trioxide $V_2O_3$, vanadium dioxide $VO_2$, vanadium oxysulfate $VOSO_4$, vanadium oxyacetylacetonate $VO(OC(=CH_2)CH_2COCH_3))_2$, vanadium acetylacetonate $V(OC(=CH_2)CH_2COCH_3))_3$, vanadium trichloride $VCl_3$, and phosphovanadomolybdic acid. It is also possible to use compounds obtained by reducing a pentavalent vanadium compound to tetravalence to divalence with an organic compound having at least one functional group selected from the group consisting of a hydroxyl group, a carbonyl group, carboxylic acid, a primary to tertiary amino group, an amide group, a phosphate group, and a phosphonic acid group.

[Heating Step]

In the heating step, the steel sheet applied with the chemical conversion treatment solution is heated, dried, and baked. As a result, a chemical conversion coating is formed on the surface of the plated layer.

With regard to the heating temperature (drying temperature), it is not preferable that the peak metal temperature is lower than 60° C. because a solvent of the surface treatment metal agent is not completely volatilized. On the other hand, when a peak metal temperature exceeds 200° C., a solvent drying effect by heating is saturated, which is not economical, and therefore, it is not preferable. Therefore, the peak metal temperature is preferably 60 to 200° C., and more preferably 80 to 150° C. In the heating step, a heating method is not limited. For example, drying can be performed by heating using IH, a hot blast furnace, or the like.

Examples

A cold-rolled steel sheet (substrate sheet for plating) having a sheet thickness of 0.8 mm and satisfying JIS G3141:2017 was immersed in a plating bath having a composition shown in Table 1, pulled up, and then wiped with $N_2$ gas to adjust an adhesion amount to an adhesion amount shown in Table 8. Thereafter, by using cooling water whose pH was adjusted by adding a pH adjusting agent shown in Table 2, water cooling was performed under the conditions shown in Table 8 to obtain plated steel sheets (O1 to O31). In Table 1, for example, Zn-6.0% Al-3.0% Mg indicates a composition containing 6.0 mass % of Al and 3.0 mass % of Mg with the remainder being Zn and impurities.

The external appearance of the obtained plated steel sheet was visually evaluated. Specifically, when whitening occurred locally or entirely, it was judged as "F (Fair)" (it can be applied to parts that are not required to have an external appearance or use with care, but it is difficult and undesirable to use it as is for parts required to have an external appearance). On the other hand, when whitening was not observed, it was judged as "G (Good)" (excellent in external appearance).

In addition, the thickness of the region where the Mg concentration is 20 to 60 mass % from the surface layer of the plated layer was measured.

For the obtained plated steel sheet, aqueous surface treatment metal agents ST1 to ST21 were prepared by mixing the silicon compounds (silane coupling agents), P compounds, fluorides, Mg compounds, and acetylacetone shown in Tables 3 to 7 in proportions shown in Table 9.

The surface treatment metal agents ST1 to ST21 were applied to plated steel sheets O1 to O31 by a roll coater, and dried to form a coating. At that time, the adhesion amount of the coating and the combination of the plated steel sheet and the surface treatment metal agent were as shown in Table 10-1 to Table 10-4. In the drying, the steel sheet was heated to a sheet temperature at drying in Tables 10-1 to 10-4 (the steel sheet temperature reached), and held for 2 seconds to form a coating.

In this way, surface-treated steel sheets Nos. 1 to 120 were manufactured.

For the obtained surface-treated steel sheets, the thickness of the chemical conversion coating, an Si concentration, a P concentration, an F concentration, a Mg concentration, a Zr concentration, and a V concentration of the chemical conversion coating were measured in the same manner as described above. The results are shown in Table 11-1 to Table 11-4. In the tables, "-" in columns of the Zr concentration and the V concentration indicates that a concentration of 0.001 mass % or more was not detected in any measurement.

Although not shown in the tables, in all examples, Si was present as a silicon compound as a result of FT-IR measurement.

In addition, the thickness of the F—Mg concentrated layer of the chemical conversion coating was measured in the same manner as described above. The results are shown in Table 11-1 to Table 11-4. At that time, the averages of the F concentration and the Mg concentration at a position of 1.0 nm were as shown in Table 11-1 to Table 11-4.

In addition, the F concentration and the Mg concentration at a site excluding the F—Mg layer were measured as described above.

For the obtained surface-treated steel sheets, corrosion resistance (SST), white rust resistance in an environment in contact with flowing water, corrosion resistance in a dew condensation environment, Erichsen worked portion corrosion resistance, blackening resistance, and external appearance were evaluated in the following manner. The results are shown in Table 12-1 to Table 12-4.

"Corrosion Resistance (SST)"

A flat sheet test piece (100 mm×100 mm) was prepared, and each test piece was subjected to a salt spray test in accordance with JIS Z 2371:2015 to evaluate the state of white rust generation on the surface after 120 hours (percentage of an area where white rust was generated in an area of the test piece).

<Evaluation Criteria>

EX (Excellent): rust generation is less than 5% of the total area.

G (Good): rust generation is 5% or more and less than 10% of the total area,

P (Poor): rust generation is 10% or more of the total area.

"White Rust Resistance in Environment in Contact with Flowing Water"

A flat sheet test piece (100 mm×100 mm) was prepared from the obtained surface-treated steel sheet, and this test piece was fixed at an angle at which the test surface was 45 degrees with respect to a vertical line. Thereafter, salt water having a salinity of 50 g/L and a pH of 6.5 to 7.2 was added dropwise to each test piece. Salt water was added dropwise through a tube having an inner diameter of 3 mm. The tip of the tube was aimed at a position shifted by 20 mm from the center portion of an upper end of the test piece toward a lower end side, and a distance between the test piece and the tip of the tube was set to be 20 mm. The dropping rate was 10 ml/s.

A dropping test was performed in a form described above, and a generation state of white rust on the surface after 120 hours was evaluated. A portion where salt water is directly dropped from the tube (a region of 20 mmφ centered on the aimed position) is referred to as a dropping portion, and a flow path of salt water flowing from the dropping portion is referred to as a flowing water portion.

Evaluation was performed according to the following evaluation criteria, and Ex or G was judged to be excellent in white rust resistance.

<Evaluation Criteria>

Ex (Excellent): No white rust is generated.

G (Good): White rust is generated at the dropping portion, and white rust is not generated at the flowing water portion.

P (Poor): White rust is generated in both the dropping portion and the flowing water portion.

"Corrosion Resistance in Dew Condensation Environment"

A flat sheet test piece (100 mm×100 mm) was prepared from the obtained surface-treated steel sheet, and 5 ml of salt water used by spraying neutral salt water according to JIS Z 2371:2015 was added dropwise to the center of the test piece. The test piece after dropwise addition of salt water was stored at 50° C. and −98% RH for 240 hours, and a state of white rust generation was evaluated. In a case of G, it was judged that corrosion resistance in a dew condensation environment is excellent.

<Evaluation Criteria>

G (Good): No white rust is generated.

P (Poor): White rust is generated

"Erichsen Worked Portion Corrosion Resistance"

A flat sheet test piece (50 mm×50 mm) was prepared from the obtained surface-treated steel sheet, subjected to an Erichsen test (7 mm extrusion), and then subjected to a salt spray test in accordance with JIS Z 2371:2015 for 120 hours to observe the state of white rust generation.

Ex or G was determined to be excellent in the Erichsen worked portion corrosion resistance.

<Evaluation Criteria>

Ex (Excellent): rust generation is less than 10% of the worked portion area.

G (Good): rust generation is 10% or more and less than 30% of the worked portion area.

P (Poor): rust generation is 30% or more of the worked portion area.

"Blackening Resistance"

A test plate (50 mm×50 mm) was prepared from the obtained surface-treated steel sheet, the test plate was held in a wet box at a temperature of 70° C. and a relative humidity of 80% for 6 days, then taken out, and a blackening state of the test plate was visually determined.

Evaluation criteria were as follows, and if G, it was judged to be acceptable, and if Ex, it was judged to be particularly excellent in blackening resistance.

Ex (Excellent): an area fraction of the blackened site is less than 1%

G (Good): the area fraction of the blackened site is 1% or more and less than 25%.

P (Poor): the area fraction of the blackened portion is 25% or more.

"External Appearance"

A test sheet (300 mm×300 mm) was prepared from the obtained surface-treated steel sheet, and the external appearance of the test plate was visually determined.

The evaluation criteria were as follows, and it was determined that G was excellent in external appearance.

G (Good): No discoloration

P (Poor): local or entire test sheet discolored

TABLE 1

| | Plating composition |
|---|---|
| A | Zn-6.0% Al-3.0% Mg |
| B | Zn-11.0% Al-3.0% Mg-0.2% Si |
| C | Zn-16.0% Al-6.0% Mg-0.2% Si |
| D | Zn-19.0% Al-6.0% Mg-1.5% Sn-0.5% Ca-0.2% Si |
| E | Zn-24.0% Al-12.0% Mg-0.5% Ca-1.2% Si |

[Table 2]

TABLE 2

| | Name |
|---|---|
| Q1 | Potassium carbonate |
| Q2 | Sodium hydrogencarbonate |
| Q3 | Methylamine |
| Q4 | Dimethylamine |

[Table 3]

TABLE 3

| | Name |
|---|---|
| A1 | 3-aminopropyltrimethoxysilane |
| A2 | 3-aminopropyltriethoxysilane |
| B1 | 3-glycidoxypropyltrimethoxysilane |
| B2 | 3-glycidoxypropyltriethoxysilane |

TABLE 4

| | Name |
|---|---|
| T1 | Phosphoric acid |
| T2 | Ammonium phosphate |

TABLE 5

| | Name |
|---|---|
| U1 | Hydrofluoric acid |
| U2 | Hydrofluorosilicic acid |
| U3 | Titanium hydrofluoric acid |
| U4 | Titanium ammonium fluoride |
| U5 | Zirconium hydrofluoric acid |
| U6 | Zirconium ammonium fluoride |

TABLE 6

| | Name |
|---|---|
| V1 | Magnesium fluoride |
| V2 | Magnesium nitrate |
| V3 | Magnesium sulfate |
| V4 | Magnesium chloride |
| V5 | Magnesium acetate |

TABLE 7

| | Name |
|---|---|
| W1 | Acetylacetone |
| W2 | Acetylacetone nickel |
| W3 | Acetylacetone manganese |
| W4 | Zinc acetylacetonate |
| W5 | Vanadium oxyacetylacetonate |

TABLE 8

| | | Water cooling conditions | | | Plated layer | | | | |
|---|---|---|---|---|---|---|---|---|---|
| No. | Substrate sheet thickness (mm) | pH adjusting agent | Cooling water pH | Temperature of steel sheet when coming into contact with cooling water (° C.) | Type | Adhesion amount (g/m$^2$) | External appearance | Mg concentration of plated surface layer (mass %) | Thickness of region where Mg concentration is 20 to 60% from surface layer of plated layer (nm) |
| O1 | 0.8 | Q1 | 10.9 | 165 | A | 90 | ○ | 25 | 2.3 |
| O2 | 0.8 | Q2 | 10.4 | 155 | B | 90 | ○ | 31 | 1.9 |
| O3 | 0.8 | Q3 | 10.5 | 151 | C | 90 | ○ | 21 | 1.3 |
| O4 | 0.8 | Q4 | 9.8 | 160 | D | 90 | ○ | 23 | 1.9 |
| O5 | 0.8 | Q1 | 10.7 | 152 | E | 90 | ○ | 25 | 1.8 |
| O6 | 0.8 | Q3 | 10.5 | 123 | C | 90 | ○ | 27 | 65 |
| O7 | 0.8 | Q4 | 10.8 | 149 | D | 90 | ○ | 56 | 25 |
| O8 | 0.8 | Q1 | 10.0 | 130 | E | 90 | ○ | 52 | 20 |
| O9 | 0.8 | Q2 | 9.9 | 125 | A | 90 | ○ | 58 | 5.3 |
| O10 | 0.8 | Q3 | 10.6 | 135 | B | 90 | ○ | 50 | 76 |
| O11 | 0.8 | Q2 | 10.0 | 100 | A | 90 | ○ | 55 | 85 |
| O12 | 0.8 | Q3 | 10.4 | 113 | B | 90 | ○ | 57 | 88 |
| O13 | 0.8 | Q4 | 10.9 | 85 | C | 90 | ○ | 45 | 100 |
| O14 | 0.8 | Q1 | 10.1 | 90 | D | 90 | ○ | 55 | 95 |
| O15 | 0.8 | Q2 | 9.6 | 108 | E | 90 | ○ | 49 | 93 |
| O16 | 0.8 | None | 5.8 | 156 | A | 90 | ○ | 4 | 0 |
| O17 | 0.8 | Q4 | 8.5 | 169 | B | 90 | ○ | 15 | 0 |
| O18 | 0.8 | None | 6.5 | 80 | C | 90 | ○ | 5 | 0 |
| O19 | 0.8 | Q2 | 8.2 | 100 | D | 90 | ○ | 11 | 0 |
| O20 | 0.8 | Q3 | 11.2 | 151 | E | 90 | X | 55 | 2.8 |
| O21 | 0.8 | Q4 | 12.0 | 165 | A | 90 | X | 59 | 2.0 |

TABLE 8-continued

| | | Water cooling conditions | | | Plated layer | | | | |
|---|---|---|---|---|---|---|---|---|---|
| No. | Substrate sheet thickness (mm) | pH adjusting agent | Cooling water pH | Temperature of steel sheet when coming into contact with cooling water (° C.) | Type | Adhesion amount (g/m$^2$) | External appearance | Mg concentration of plated surface layer (mass %) | Thickness of region where Mg concentration is 20 to 60% from surface layer of plated layer (nm) |
| O22 | 0.8 | Q1 | 12.3 | 100 | B | 90 | X | 65 | 89 |
| O23 | 0.8 | Q2 | 11.5 | 95 | C | 90 | X | 62 | 105 |
| O24 | 0.8 | Q3 | 10.5 | 200 | D | 90 | ○ | 13 | 0 |
| O25 | 0.8 | Q4 | 9.5 | 220 | E | 90 | ○ | 9 | 0 |
| O26 | 0.8 | Q1 | 12.5 | 200 | A | 90 | X | 7 | 0 |
| O27 | 0.8 | Q2 | 11.5 | 220 | B | 90 | X | 5 | 0 |
| O28 | 0.8 | Q4 | 7.8 | 139 | C | 90 | ○ | 10 | 0 |
| O29 | 0.8 | Q1 | 8.3 | 135 | D | 90 | ○ | 9 | 0 |
| O30 | 0.8 | Q2 | 11.8 | 139 | E | 90 | X | 57 | 68 |
| O31 | 0.8 | Q3 | 11.1 | 135 | A | 90 | X | 58 | 65 |

TABLE 9

| | Organosilicon compound (S) | | | P compound (T) | | F compound (U) | | Mg compound (V) | | Acetylacetone (W) | |
|---|---|---|---|---|---|---|---|---|---|---|---|
| | Silane coupling agent | | Ratio | | Ratio | | Ratio | | Ratio | | Ratio |
| No. | A | B | A/B | Type | Ts/Ss | Type | Us/Xs | Type | Vs/Xs | Type | Wmol/Vmol |
| ST1 | A1 | B1 | 1.2 | T1 | 0.23 | U1 | 0.02 | V1 | 0.44 | W1 | 3.1 |
| ST2 | A1 | B2 | 0.9 | T1 | 0.29 | U2 | 0.33 | V2 | 0.10 | W2 | 1.3 |
| ST3 | A2 | B1 | 0.5 | T2 | 0.25 | U3 | 0.44 | V3 | 0.13 | W3 | 1.5 |
| ST4 | A2 | B2 | 0.8 | T2 | 0.25 | U4 | 0.14 | V4 | 0.60 | W4 | 2.0 |
| ST5 | A1 | B1 | 1.3 | T2 | 0.25 | U5 | 0.33 | V5 | 0.28 | W5 | 4.5 |
| ST6 | A1 | B2 | 1.5 | T2 | 0.28 | U6 | 0.25 | V1 | 0.06 | W1 | 2.5 |
| ST7 | A2 | B1 | 1.1 | T1 | 0.19 | U1 | 0.49 | V2 | 0.17 | W2 | 3.2 |
| ST8 | A2 | B2 | 1.4 | T1 | 0.23 | U2 | 0.11 | V3 | 0.19 | W3 | 2.3 |
| ST9 | A1 | B1 | 0.8 | T1 | 0.29 | U3 | 0.005 | V4 | 0.13 | W4 | 1.2 |
| ST10 | A1 | B2 | 1.0 | T1 | 0.23 | U4 | 0.01 | V5 | 0.15 | W5 | 4.5 |
| ST11 | A2 | B1 | 0.9 | T2 | 0.15 | U5 | 0.72 | V1 | 0.41 | W1 | 8.9 |
| ST12 | A2 | B2 | 1.2 | T2 | 0.15 | U6 | 1.10 | V2 | 0.17 | W2 | 7.6 |
| ST13 | A1 | B1 | 0.7 | T2 | 0.29 | U1 | 0.44 | V3 | 0.03 | W3 | 1.5 |
| ST14 | A1 | B2 | 1.2 | T2 | 0.19 | U2 | 0.42 | V4 | 0.02 | W4 | 3.7 |
| ST15 | A1 | B1 | 1.1 | T1 | 0.22 | U5 | 0.23 | V2 | 0.80 | W5 | 2.3 |
| ST16 | A1 | B2 | 1.5 | T1 | 0.23 | U6 | 0.02 | V3 | 1.25 | W1 | 4.3 |
| ST17 | A2 | B1 | 0.7 | T2 | 0.17 | U1 | 0.11 | V4 | 0.56 | W2 | 0.1 |
| ST18 | A2 | B2 | 1.6 | T2 | 0.26 | U2 | 0.25 | V5 | 0.25 | W3 | 0.8 |
| ST19 | A1 | B1 | 0.5 | T2 | 0.23 | U3 | 1.20 | V1 | 0.01 | W4 | 3.0 |
| ST20 | A1 | B2 | 0.6 | T2 | 0.15 | U4 | 0.79 | V2 | 0.02 | W5 | 2.5 |
| ST21 | A1 | B1 | 0.7 | T2 | 0.30 | U1 | 0.50 | V3 | 0.00 | W3 | 1.5 |

TABLE 10-1

| | Manufacturing conditions | | | Chemical conversion coating | | | | | | |
|---|---|---|---|---|---|---|---|---|---|---|
| No. | Substrate sheet | Metal surface treatment agent | Sheet temperature at drying(° C.) | Si concen-tration (mass %) | P concen-tration (mass %) | F concen-tration (mass %) | Mg concentration (mass %) | Zr concentration (mass %) | V concentration (mass %) | Coating thickness (μm) |
| 1 | O1 | ST1 | 152 | 17.21 | 1.36 | 0.20 | 0.22 | — | — | 0.5 |
| 2 | O2 | ST2 | 136 | 22.53 | 4.72 | 0.10 | 0.21 | — | — | 1.1 |
| 3 | O3 | ST3 | 190 | 23.59 | 1.98 | 0.39 | 0.13 | — | — | 1.2 |
| 4 | O4 | ST4 | 137 | 13.90 | 3.86 | 0.48 | 0.38 | — | — | 0.6 |
| 5 | O5 | ST5 | 122 | 11.65 | 1.58 | 0.51 | 0.29 | 0.80 | 0.50 | 0.4 |
| 6 | O1 | ST6 | 91 | 12.52 | 4.25 | 0.30 | 0.10 | 0.21 | — | 1.8 |
| 7 | O2 | ST7 | 114 | 11.48 | 3.36 | 0.39 | 0.19 | — | — | 1.9 |
| 8 | O3 | ST8 | 122 | 17.96 | 1.44 | 0.22 | 0.17 | — | — | 1.2 |
| 9 | O4 | ST1 | 63 | 14.50 | 4.25 | 0.35 | 0.19 | — | — | 1.4 |

TABLE 10-1-continued

| | Manufacturing conditions | | | Chemical conversion coating | | | | | | |
|---|---|---|---|---|---|---|---|---|---|---|
| No. | Substrate sheet | Metal surface treatment agent | Sheet temperature at drying(° C.) | Si concen-tration (mass %) | P concen-tration (mass %) | F concen-tration (mass %) | Mg concentration (mass %) | Zr concentration (mass %) | V concentration (mass %) | Coating thickness (μm) |
| 10 | O5 | ST2 | 141 | 24.20 | 2.01 | 0.37 | 0.38 | — | — | 1.5 |
| 11 | O6 | ST3 | 179 | 20.99 | 0.30 | 0.39 | 0.37 | — | — | 1.4 |
| 12 | O7 | ST4 | 62 | 13.67 | 4.47 | 0.25 | 0.51 | — | — | 1.0 |
| 13 | O8 | ST5 | 117 | 10.62 | 2.48 | 0.48 | 0.32 | 0.52 | 1.02 | 1.8 |
| 14 | O9 | ST6 | 163 | 16.90 | 4.60 | 0.22 | 0.21 | 0.48 | — | 0.3 |
| 15 | O10 | ST7 | 69 | 14.38 | 0.36 | 0.13 | 0.36 | — | — | 1.9 |
| 16 | O6 | ST8 | 176 | 14.05 | 3.49 | 0.21 | 0.46 | — | — | 1.2 |
| 17 | O7 | ST1 | 141 | 22.60 | 0.93 | 0.19 | 0.29 | — | — | 1.8 |
| 18 | O8 | ST2 | 79 | 19.06 | 1.46 | 0.18 | 0.11 | — | — | 1.9 |
| 19 | O9 | ST3 | 97 | 16.23 | 2.06 | 0.28 | 0.16 | — | — | 0.7 |
| 20 | O10 | ST4 | 134 | 20.96 | 4.89 | 0.19 | 0.14 | — | — | 0.6 |
| 21 | O11 | ST5 | 137 | 13.93 | 3.45 | 0.23 | 0.24 | 0.58 | 0.87 | 1.1 |
| 22 | O12 | ST6 | 117 | 21.66 | 3.67 | 0.37 | 0.11 | 0.42 | — | 1.1 |
| 23 | O13 | ST7 | 66 | 20.78 | 2.05 | 0.19 | 0.09 | — | — | 1.8 |
| 24 | O14 | ST8 | 103 | 13.06 | 3.21 | 0.45 | 0.45 | — | — | 0.6 |
| 25 | O15 | ST1 | 71 | 16.93 | 3.49 | 0.08 | 0.13 | — | — | 1.3 |
| 26 | O11 | ST2 | 121 | 16.14 | 4.14 | 0.11 | 0.42 | — | — | 1.0 |
| 27 | O12 | ST3 | 145 | 13.13 | 0.23 | 0.32 | 0.48 | — | — | 0.4 |
| 28 | O13 | ST4 | 79 | 23.86 | 4.07 | 0.50 | 0.48 | — | — | 1.7 |
| 29 | O14 | ST5 | 125 | 15.84 | 4.14 | 0.41 | 0.30 | 0.60 | 0.63 | 0.7 |

TABLE 10-2

| | Manufacturing conditions | | | Chemical conversion coating | | | | | | |
|---|---|---|---|---|---|---|---|---|---|---|
| No. | Substrate sheet | Metal surface treatment agent | Sheet temperature at drying(° C.) | Si concentration (mass %) | P concen-tration (mass %) | F concen-tration (mass %) | Mg concentration (mass %) | Zr concentration (mass %) | V concentration (mass %) | Coating thickness (μm) |
| 30 | O15 | ST6 | 84 | 19.18 | 2.57 | 0.46 | 0.29 | — | — | 1.1 |
| 31 | O16 | ST1 | 157 | 24.83 | 0.32 | 0.23 | 0.54 | — | — | 1.1 |
| 32 | O17 | ST2 | 104 | 11.70 | 2.35 | 0.49 | 0.13 | — | — | 1.9 |
| 33 | O16 | ST3 | 83 | 22.31 | 4.30 | 0.29 | 0.16 | — | — | 0.2 |
| 34 | O17 | ST4 | 84 | 15.91 | 3.75 | 0.39 | 0.26 | — | — | 0.9 |
| 35 | O16 | ST5 | 151 | 16.54 | 2.12 | 0.13 | 0.10 | 0.29 | 0.75 | 0.4 |
| 36 | O17 | ST6 | 173 | 20.93 | 0.29 | 0.21 | 0.50 | 0.36 | — | 0.2 |
| 37 | O16 | ST7 | 164 | 23.47 | 0.43 | 0.08 | 0.11 | — | — | 1.7 |
| 38 | O17 | ST8 | 77 | 18.91 | 0.47 | 0.18 | 0.24 | — | — | 0.3 |
| 39 | O18 | ST1 | 159 | 23.70 | 2.00 | 0.10 | 0.34 | — | — | 1.4 |
| 40 | O19 | ST2 | 103 | 18.06 | 3.42 | 0.20 | 0.41 | — | — | 0.3 |
| 41 | O18 | ST3 | 70 | 11.71 | 0.80 | 0.13 | 0.22 | — | — | 0.8 |
| 42 | O19 | ST4 | 169 | 14.95 | 0.33 | 0.32 | 0.18 | — | — | 0.5 |
| 43 | O18 | ST5 | 177 | 15.35 | 4.58 | 0.48 | 0.14 | 0.85 | 1.48 | 1.7 |
| 44 | O19 | ST6 | 84 | 15.49 | 2.49 | 0.31 | 0.36 | 0.77 | — | 1.2 |
| 45 | O18 | ST7 | 128 | 24.29 | 3.05 | 0.41 | 0.15 | — | — | 1.6 |
| 46 | O19 | ST8 | 140 | 18.10 | 2.88 | 0.24 | 0.18 | — | — | 1.3 |
| 47 | O20 | ST1 | 117 | 15.94 | 2.39 | 0.12 | 0.13 | — | — | 0.3 |
| 48 | O21 | ST2 | 142 | 10.77 | 4.46 | 0.17 | 0.50 | — | — | 2.0 |
| 49 | O20 | ST3 | 106 | 24.52 | 0.90 | 0.18 | 0.21 | — | — | 0.6 |
| 50 | O21 | ST4 | 168 | 17.93 | 3.24 | 0.21 | 0.21 | — | — | 0.5 |
| 51 | O20 | ST5 | 176 | 23.28 | 4.60 | 0.21 | 0.38 | 0.29 | 1.41 | 1.6 |
| 52 | O21 | ST6 | 123 | 21.77 | 0.41 | 0.18 | 0.40 | 0.89 | — | 1.0 |
| 53 | O20 | ST7 | 166 | 18.13 | 1.25 | 0.09 | 0.21 | — | — | 1.1 |
| 54 | O21 | ST8 | 163 | 19.92 | 0.62 | 0.33 | 0.47 | — | — | 1.5 |
| 55 | O22 | ST1 | 175 | 23.41 | 2.87 | 0.17 | 0.42 | — | — | 1.5 |
| 56 | O23 | ST2 | 190 | 11.22 | 4.81 | 0.23 | 0.49 | — | — | 0.6 |
| 57 | O22 | ST3 | 118 | 15.81 | 3.09 | 0.14 | 0.05 | — | — | 0.2 |
| 58 | O23 | ST4 | 110 | 20.78 | 3.70 | 0.19 | 0.24 | — | — | 0.4 |
| 59 | O22 | ST5 | 121 | 22.50 | 1.46 | 0.17 | 0.26 | 0.87 | 1.68 | 0.2 |
| 60 | O23 | ST6 | 151 | 17.13 | 0.58 | 0.36 | 0.10 | 0.69 | — | 0.9 |
| 61 | O22 | ST7 | 140 | 14.97 | 2.26 | 0.42 | 0.37 | — | — | 0.9 |

TABLE 10-3

| | Manufacturing conditions | | | Chemical conversion coating | | | | | | |
|---|---|---|---|---|---|---|---|---|---|---|
| No. | Substrate sheet | Metal surface treatment agent | Sheet temperature at drying(° C.) | Si concentration (mass %) | P concen-tration (mass %) | F concen-tration (mass %) | Mg concentration (mass %) | Zr concentration (mass %) | V concentration (mass %) | Coating thickness (μm) |
| 62 | O23 | ST8 | 129 | 24.80 | 3.69 | 0.48 | 0.45 | — | — | 1.5 |
| 63 | O24 | ST1 | 120 | 20.23 | 3.23 | 0.14 | 0.37 | — | — | 0.9 |
| 64 | O25 | ST2 | 181 | 24.64 | 3.58 | 0.51 | 0.25 | — | — | 0.7 |
| 65 | O24 | ST3 | 101 | 18.49 | 4.23 | 0.48 | 0.46 | — | — | 0.7 |
| 66 | O25 | ST4 | 144 | 18.79 | 3.47 | 0.20 | 0.33 | — | — | 1.3 |
| 67 | O24 | ST5 | 193 | 20.70 | 1.96 | 0.24 | 0.24 | 0.25 | 1.82 | 1.0 |
| 68 | O25 | ST6 | 150 | 23.25 | 1.93 | 0.24 | 0.48 | 0.86 | — | 1.0 |
| 69 | O24 | ST7 | 152 | 23.54 | 3.73 | 0.24 | 0.49 | — | — | 0.9 |
| 70 | O25 | ST8 | 161 | 12.36 | 4.53 | 0.43 | 0.14 | — | — | 1.1 |
| 71 | O26 | ST1 | 118 | 16.70 | 3.29 | 0.19 | 0.48 | — | — | 0.6 |
| 72 | O27 | ST2 | 166 | 15.47 | 4.24 | 0.30 | 0.45 | — | — | 1.1 |
| 73 | O26 | ST3 | 129 | 16.21 | 0.27 | 0.11 | 0.34 | — | — | 1.7 |
| 74 | O27 | ST4 | 134 | 15.59 | 0.40 | 0.13 | 0.21 | — | — | 0.9 |
| 75 | O26 | ST5 | 139 | 18.42 | 4.50 | 0.34 | 0.08 | 0.29 | 1.01 | 1.6 |
| 76 | O27 | ST6 | 125 | 13.26 | 4.10 | 0.48 | 0.49 | 0.20 | — | 0.7 |
| 77 | O26 | ST7 | 114 | 14.77 | 1.68 | 0.51 | 0.21 | — | — | 1.6 |
| 78 | O27 | ST8 | 160 | 11.23 | 4.53 | 0.37 | 0.09 | — | — | 1.3 |
| 79 | O28 | ST1 | 165 | 14.54 | 2.75 | 0.30 | 0.17 | — | — | 0.8 |
| 80 | O29 | ST2 | 183 | 11.12 | 2.54 | 0.47 | 0.10 | — | — | 0.2 |
| 81 | O28 | ST3 | 170 | 20.56 | 4.21 | 0.08 | 0.23 | — | — | 1.2 |
| 82 | O29 | ST4 | 77 | 15.11 | 1.30 | 0.40 | 0.40 | — | — | 0.2 |
| 83 | O28 | ST5 | 156 | 19.58 | 1.67 | 0.26 | 0.35 | 0.35 | 0.51 | 0.6 |
| 84 | O29 | ST6 | 144 | 10.76 | 1.19 | 0.07 | 0.15 | 0.51 | — | 0.6 |
| 85 | O28 | ST7 | 65 | 10.85 | 3.56 | 0.50 | 0.48 | — | — | 0.3 |
| 86 | O29 | ST8 | 175 | 12.16 | 1.45 | 0.29 | 0.35 | — | — | 1.8 |
| 87 | O30 | ST1 | 66 | 23.41 | 3.90 | 0.11 | 0.23 | — | — | 1.8 |
| 88 | O31 | ST2 | 117 | 20.13 | 2.10 | 0.42 | 0.06 | — | — | 1.5 |
| 89 | O30 | ST3 | 157 | 22.86 | 1.94 | 0.25 | 0.48 | — | — | 1.0 |
| 90 | O31 | ST4 | 194 | 21.29 | 1.90 | 0.23 | 0.40 | — | — | 1.3 |
| 91 | O30 | ST5 | 99 | 23.71 | 4.13 | 0.39 | 0.06 | 0.74 | 1.86 | 1.8 |
| 92 | O31 | ST6 | 72 | 14.58 | 2.77 | 0.20 | 0.47 | 0.78 | — | 0.3 |
| 93 | O30 | ST7 | 195 | 12.84 | 3.33 | 0.24 | 0.34 | — | — | 0.9 |

35

TABLE 10-4

| | Manufacturing conditions | | | Chemical conversion coating | | | | | | |
|---|---|---|---|---|---|---|---|---|---|---|
| No. | Substrate sheet | Metal surface treatment agent | Sheet temperature at drying(° C.) | Si concentration (mass %) | P concen-tration (mass %) | F concen-tration (mass %) | Mg concentration (mass %) | Zr concentration (mass %) | V concentration (mass %) | Coating thickness (μm) |
| 94 | O31 | ST8 | 137 | 19.50 | 2.53 | 0.37 | 0.42 | — | — | 1.1 |
| 95 | O6 | ST9 | 133 | 11.20 | 0.44 | 0.17 | 0.13 | — | — | 0.8 |
| 96 | O7 | ST10 | 100 | 24.32 | 1.23 | 0.16 | 0.41 | — | 0.86 | 1.3 |
| 97 | O8 | ST9 | 162 | 15.21 | 4.59 | 0.13 | 0.49 | — | — | 1.3 |
| 98 | O9 | ST10 | 105 | 24.07 | 4.83 | 0.22 | 0.35 | — | 0.24 | 1.6 |
| 99 | O10 | ST11 | 196 | 11.24 | 3.58 | 0.77 | 0.29 | 0.18 | — | 0.9 |
| 100 | O6 | ST12 | 115 | 19.37 | 2.64 | 0.79 | 0.42 | 0.12 | — | 1.6 |
| 101 | O7 | ST11 | 122 | 19.68 | 1.79 | 0.92 | 0.34 | 0.38 | — | 1.6 |
| 102 | O8 | ST12 | 154 | 24.36 | 4.70 | 0.78 | 0.45 | 0.76 | — | 0.8 |
| 103 | O9 | ST13 | 107 | 20.58 | 3.21 | 0.25 | 0.12 | — | — | 1.9 |
| 104 | O10 | ST14 | 123 | 14.23 | 0.99 | 0.32 | 0.11 | — | — | 0.4 |
| 105 | O6 | ST13 | 117 | 24.49 | 2.77 | 0.39 | 0.06 | — | — | 1.7 |
| 106 | O7 | ST14 | 109 | 20.45 | 1.91 | 0.14 | 0.11 | — | — | 0.2 |
| 107 | O8 | ST15 | 108 | 18.38 | 3.01 | 0.33 | 0.94 | 0.58 | 0.95 | 0.5 |
| 108 | O9 | ST16 | 81 | 19.08 | 2.34 | 0.30 | 0.76 | 0.43 | — | 0.4 |
| 109 | O10 | ST15 | 91 | 17.03 | 4.70 | 0.21 | 0.61 | 0.35 | 1.65 | 0.5 |
| 110 | O6 | ST16 | 182 | 23.41 | 4.24 | 0.22 | 0.75 | 0.69 | — | 0.7 |
| 111 | O7 | ST17 | 133 | 22.25 | 2.66 | 0.18 | 0.16 | — | — | 0.4 |
| 112 | O8 | ST18 | 64 | 17.62 | 4.72 | 0.21 | 0.22 | — | — | 1.6 |
| 113 | O9 | ST17 | 124 | 20.19 | 4.88 | 0.08 | 0.46 | — | — | 1.2 |
| 114 | O10 | ST18 | 144 | 17.50 | 0.34 | 0.13 | 0.15 | — | — | 1.0 |
| 115 | O6 | ST19 | 166 | 11.12 | 2.58 | 0.65 | 0.44 | — | — | 0.3 |
| 116 | O7 | ST20 | 104 | 12.79 | 3.34 | 0.65 | 0.16 | — | 1.16 | 0.3 |
| 117 | O8 | ST19 | 189 | 19.54 | 2.81 | 0.69 | 0.23 | — | — | 0.3 |

TABLE 10-4-continued

| | Manufacturing conditions | | | Chemical conversion coating | | | | | | |
|---|---|---|---|---|---|---|---|---|---|---|
| No. | Substrate sheet | Metal surface treatment agent | Sheet temperature at drying(° C.) | Si concentration (mass %) | P concen-tration (mass %) | F concen-tration (mass %) | Mg concentration (mass %) | Zr concentration (mass %) | V concentration (mass %) | Coating thickness (μm) |
| 118 | O9 | ST20 | 105 | 22.80 | 4.24 | 0.97 | 0.52 | — | 1.83 | 0.5 |
| 119 | O16 | ST21 | 130 | 16.52 | 3.62 | 0.21 | 0.23 | — | — | 0.4 |
| 120 | O1 | ST21 | 145 | 19.32 | 5.24 | 1.01 | 0.33 | — | — | 0.7 |

TABLE 11-1

| | Element concentration at position of 1.0 nm from interface between plated layer and chemical conversion coating in chemical conversion coating | | F—Mg concentrated layer | Element concentration at site excluding F—Mg concentrated layer | |
|---|---|---|---|---|---|
| No. | F concentration (mass %) | Mg concentration (mass %) | thickness (nm) | F concentration (mass %) | Mg concentration (mass %) |
| 1 | 3.50 | 17.20 | 1.8 | 0.18 | 0.20 |
| 2 | 2.80 | 24.50 | 2.2 | 0.09 | 0.20 |
| 3 | 2.50 | 15.90 | 2.2 | 0.35 | 0.11 |
| 4 | 3.60 | 29.10 | 1.8 | 0.44 | 0.38 |
| 5 | 2.40 | 21.70 | 2.0 | 0.48 | 0.25 |
| 6 | 4.30 | 20.10 | 1.5 | 0.25 | 0.10 |
| 7 | 3.70 | 18.70 | 1.9 | 0.36 | 0.19 |
| 8 | 2.20 | 39.60 | 1.3 | 0.18 | 0.17 |
| 9 | 1.10 | 23.10 | 2.2 | 0.34 | 0.19 |
| 10 | 0.80 | 34.50 | 3.7 | 0.33 | 0.34 |
| 11 | 4.11 | 28.45 | 72.1 | 0.35 | 0.36 |
| 12 | 1.51 | 26.14 | 18.0 | 0.21 | 0.47 |
| 13 | 3.74 | 35.02 | 53.5 | 0.45 | 0.29 |
| 14 | 3.55 | 18.40 | 97.9 | 0.19 | 0.18 |
| 15 | 3.50 | 9.94 | 7.8 | 0.11 | 0.34 |
| 16 | 0.72 | 21.88 | 80.4 | 0.18 | 0.43 |
| 17 | 2.21 | 3.52 | 52.7 | 0.17 | 0.26 |
| 18 | 2.53 | 7.83 | 82.6 | 0.16 | 0.07 |
| 19 | 3.66 | 2.45 | 69.0 | 0.24 | 0.11 |
| 20 | 2.12 | 34.00 | 98.7 | 0.18 | 0.12 |
| 21 | 2.92 | 24.84 | 118.6 | 0.20 | 0.23 |
| 22 | 1.01 | 3.84 | 108.4 | 0.35 | 0.07 |
| 23 | 1.60 | 18.96 | 114.5 | 0.14 | 0.06 |
| 24 | 3.21 | 9.66 | 111.8 | 0.45 | 0.42 |
| 25 | 3.33 | 11.83 | 115.7 | 0.05 | 0.12 |
| 26 | 1.18 | 27.72 | 108.8 | 0.11 | 0.39 |
| 27 | 4.70 | 16.50 | 118.4 | 0.30 | 0.47 |
| 28 | 3.70 | 31.03 | 119.8 | 0.46 | 0.47 |
| 29 | 4.53 | 7.13 | 104.3 | 0.40 | 0.27 |

TABLE 11-2

| | Element concentration at position of 1.0 nm from interface between plated layer and chemical conversion coating in chemical conversion coating | | F—Mg concentrated layer | Element concentration at site excluding F—Mg concentrated layer | |
|---|---|---|---|---|---|
| No. | F concentration (mass %) | Mg concentration (mass %) | thickness (nm) | F concentration (mass %) | Mg concentration (mass %) |
| 30 | 1.11 | 3.25 | 115.6 | 0.44 | 0.29 |
| 31 | 0.05 | 1.34 | 0.0 | 0.20 | 0.49 |
| 32 | 0.33 | 1.07 | 0.0 | 0.48 | 0.12 |
| 33 | 0.14 | 1.33 | 0.0 | 0.28 | 0.11 |
| 34 | 0.14 | 0.93 | 0.0 | 0.37 | 0.25 |
| 35 | 0.36 | 0.78 | 0.0 | 0.12 | 0.06 |
| 36 | 0.39 | 0.95 | 0.0 | 0.18 | 0.48 |
| 37 | 0.44 | 0.75 | 0.0 | 0.08 | 0.10 |
| 38 | 0.07 | 1.02 | 0.0 | 0.17 | 0.23 |
| 39 | 0.28 | 1.13 | 0.0 | 0.08 | 0.32 |

TABLE 11-2-continued

| No. | Element concentration at position of 1.0 nm from interface between plated layer and chemical conversion coating in chemical conversion coating | | F—Mg concentrated layer | Element concentration at site excluding F—Mg concentrated layer | |
|---|---|---|---|---|---|
| | F concentration (mass %) | Mg concentration (mass %) | thickness (nm) | F concentration (mass %) | Mg concentration (mass %) |
| 40 | 0.09 | 0.88 | 0.0 | 0.18 | 0.38 |
| 41 | 0.13 | 0.28 | 0.0 | 0.09 | 0.19 |
| 42 | 0.28 | 0.96 | 0.0 | 0.28 | 0.17 |
| 43 | 0.10 | 0.57 | 0.0 | 0.43 | 0.11 |
| 44 | 0.09 | 1.16 | 0.0 | 0.26 | 0.35 |
| 45 | 0.16 | 0.75 | 0.0 | 0.39 | 0.14 |
| 46 | 0.37 | 0.83 | 0.0 | 0.21 | 0.16 |
| 47 | 1.81 | 4.02 | 3.0 | 0.08 | 0.11 |
| 48 | 3.81 | 36.71 | 3.0 | 0.15 | 0.46 |
| 49 | 0.95 | 34.11 | 2.0 | 0.14 | 0.19 |
| 50 | 3.06 | 30.69 | 4.0 | 0.19 | 0.20 |
| 51 | 0.88 | 24.23 | 3.9 | 0.19 | 0.35 |
| 52 | 2.91 | 23.96 | 1.5 | 0.15 | 0.38 |
| 53 | 3.16 | 17.61 | 1.9 | 0.08 | 0.20 |
| 54 | 1.77 | 20.44 | 1.3 | 0.29 | 0.46 |
| 55 | 4.17 | 54.75 | 0.0 | 0.15 | 0.39 |
| 56 | 3.51 | 51.05 | 0.0 | 0.20 | 0.48 |
| 57 | 1.03 | 45.10 | 0.0 | 0.11 | 0.04 |
| 58 | 1.57 | 52.96 | 0.0 | 0.17 | 0.20 |
| 59 | 1.15 | 55.79 | 0.0 | 0.16 | 0.25 |
| 60 | 4.01 | 50.30 | 0.0 | 0.31 | 0.08 |
| 61 | 1.33 | 57.16 | 0.0 | 0.39 | 0.36 |

TABLE 11-3

| No. | Element concentration at position of 1.0 nm from interface between plated layer and chemical conversion coating in chemical conversion coating | | F—Mg concentrated layer | Element concentration at site excluding F—Mg concentrated layer | |
|---|---|---|---|---|---|
| | F concentration (mass %) | Mg concentration (mass %) | thickness (nm) | F concentration (mass %) | Mg concentration (mass %) |
| 62 | 0.82 | 42.35 | 0.0 | 0.45 | 0.44 |
| 63 | 0.42 | 0.89 | 0.0 | 0.11 | 0.35 |
| 64 | 0.26 | 0.20 | 0.0 | 0.47 | 0.20 |
| 65 | 0.26 | 0.76 | 0.0 | 0.45 | 0.44 |
| 66 | 0.36 | 0.77 | 0.0 | 0.18 | 0.32 |
| 67 | 0.04 | 0.65 | 0.0 | 0.22 | 0.21 |
| 68 | 0.33 | 0.53 | 0.0 | 0.19 | 0.46 |
| 69 | 0.48 | 0.87 | 0.0 | 0.24 | 0.45 |
| 70 | 0.01 | 0.40 | 0.0 | 0.39 | 0.09 |
| 71 | 0.02 | 0.74 | 0.0 | 0.18 | 0.46 |
| 72 | 0.31 | 0.43 | 0.0 | 0.28 | 0.40 |
| 73 | 0.36 | 0.76 | 0.0 | 0.07 | 0.33 |
| 74 | 0.24 | 0.77 | 0.0 | 0.11 | 0.19 |
| 75 | 0.35 | 1.45 | 0.0 | 0.31 | 0.08 |
| 76 | 0.35 | 0.74 | 0.0 | 0.45 | 0.48 |
| 77 | 0.11 | 1.08 | 0.0 | 0.49 | 0.19 |
| 78 | 0.42 | 1.37 | 0.0 | 0.35 | 0.06 |
| 79 | 0.14 | 0.38 | 0.0 | 0.25 | 0.17 |
| 80 | 0.23 | 1.46 | 0.0 | 0.42 | 0.05 |
| 81 | 0.15 | 0.25 | 0.0 | 0.08 | 0.20 |
| 82 | 0.28 | 0.49 | 0.0 | 0.37 | 0.39 |
| 83 | 0.39 | 0.85 | 0.0 | 0.23 | 0.33 |
| 84 | 0.48 | 0.32 | 0.0 | 0.06 | 0.15 |
| 85 | 0.36 | 1.26 | 0.0 | 0.46 | 0.47 |
| 86 | 0.48 | 1.08 | 0.0 | 0.27 | 0.33 |
| 87 | 3.78 | 16.80 | 88.0 | 0.11 | 0.20 |
| 88 | 3.83 | 15.33 | 29.8 | 0.38 | 0.06 |
| 89 | 3.98 | 36.25 | 65.6 | 0.21 | 0.44 |
| 90 | 2.32 | 14.45 | 63.7 | 0.20 | 0.39 |
| 91 | 3.80 | 13.63 | 47.0 | 0.37 | 0.06 |
| 92 | 0.85 | 16.95 | 91.1 | 0.20 | 0.42 |
| 93 | 3.16 | 26.09 | 98.8 | 0.22 | 0.31 |

TABLE 11-4

| No. | Element concentration at position of 1.0 nm from interface between plated layer and chemical conversion coating in chemical conversion coating | | F—Mg concentrated layer | Element concentration at site excluding F—Mg concentrated layer | |
|---|---|---|---|---|---|
| | F concentration (mass %) | Mg concentration (mass %) | thickness (nm) | F concentration (mass %) | Mg concentration (mass %) |
| 94 | 4.21 | 30.25 | 71.1 | 0.33 | 0.42 |
| 95 | 0.08 | 22.47 | 0.0 | 0.16 | 0.11 |
| 96 | 0.10 | 22.90 | 0.0 | 0.11 | 0.38 |
| 97 | 0.15 | 10.56 | 0.0 | 0.12 | 0.48 |
| 98 | 0.16 | 25.55 | 0.0 | 0.18 | 0.35 |
| 99 | 10.66 | 24.61 | 0.0 | 0.74 | 0.26 |
| 100 | 6.81 | 3.22 | 0.0 | 0.75 | 0.39 |
| 101 | 6.96 | 6.77 | 0.0 | 0.87 | 0.34 |
| 102 | 5.70 | 28.79 | 0.0 | 0.77 | 0.44 |
| 103 | 0.15 | 29.17 | 0.0 | 0.22 | 0.10 |
| 104 | 0.06 | 24.82 | 0.0 | 0.30 | 0.09 |
| 105 | 0.48 | 37.66 | 0.0 | 0.38 | 0.05 |
| 106 | 0.31 | 18.35 | 0.0 | 0.12 | 0.09 |
| 107 | 4.18 | 54.75 | 0.0 | 0.29 | 0.89 |
| 108 | 0.58 | 47.94 | 0.0 | 0.28 | 0.74 |
| 109 | 4.45 | 60.04 | 0.0 | 0.21 | 0.59 |
| 110 | 4.24 | 55.71 | 0.0 | 0.20 | 0.71 |
| 111 | 0.27 | 14.44 | 0.0 | 0.15 | 0.12 |
| 112 | 0.47 | 26.87 | 0.0 | 0.17 | 0.22 |
| 113 | 0.45 | 4.49 | 0.0 | 0.06 | 0.45 |
| 114 | 0.14 | 36.54 | 0.0 | 0.09 | 0.11 |
| 115 | 0.35 | 10.77 | 0.0 | 0.64 | 0.41 |
| 116 | 0.35 | 4,42 | 0.0 | 0.65 | 0.15 |
| 117 | 0.22 | 14.59 | 0.0 | 0.66 | 0.21 |
| 118 | 0.28 | 8.92 | 0.0 | 0.93 | 0.48 |
| 119 | 0.01 | 0.02 | 0.0 | 0.12 | 0.03 |
| 120 | 0.05 | 3.50 | 0.0 | 0.25 | 0.08 |

TABLE 12-1

| No. | Quality characteristics | | | | | |
|---|---|---|---|---|---|---|
| | Corrosion resistance (SST) | White rust resistance in environment in contact with flowing water | Corrosion resistance in dew condensation environment | Erichsen worked portion corrosion resistance | Blackening resistance | External appearance |
| 1 | G | G | G | G | G | G |
| 2 | G | G | G | G | G | G |
| 3 | G | G | G | G | Ex | G |
| 4 | G | G | G | G | G | G |
| 5 | G | G | G | G | G | G |
| 6 | G | G | G | G | G | G |
| 7 | G | G | G | G | G | G |
| 8 | G | G | G | G | Ex | G |
| 9 | G | G | G | G | G | G |
| 10 | G | G | G | G | G | G |
| 11 | Ex | Ex | G | Ex | G | G |
| 12 | Ex | Ex | G | Ex | G | G |
| 13 | Ex | Ex | G | Ex | G | G |
| 14 | Ex | Ex | G | Ex | Ex | G |
| 15 | Ex | Ex | G | Ex | G | G |
| 16 | Ex | Ex | G | Ex | G | G |
| 17 | Ex | Ex | G | Ex | G | G |
| 18 | Ex | Ex | G | Ex | Ex | G |
| 19 | Ex | Ex | G | Ex | G | G |
| 20 | Ex | Ex | G | Ex | G | G |
| 21 | Ex | Ex | G | G | G | G |
| 22 | Ex | Ex | G | G | G | G |
| 23 | Ex | Ex | G | G | G | G |
| 24 | Ex | Ex | G | G | G | G |
| 25 | Ex | Ex | G | G | G | G |
| 26 | Ex | Ex | G | G | G | G |
| 27 | Ex | Ex | G | G | G | G |
| 28 | Ex | Ex | G | G | G | G |
| 29 | Ex | Ex | G | G | G | G |

TABLE 12-2

| No. | Quality characteristics | | | | | |
|---|---|---|---|---|---|---|
| | Corrosion resistance (SST) | White rust resistance in environment in contact with flowing water | Corrosion resistance in dew condensation environment | Erichsen worked portion corrosion resistance | Blackening resistance | External appearance |
| 30 | Ex | Ex | G | G | G | G |
| 31 | G | P | G | G | G | G |
| 32 | G | P | G | G | G | G |
| 33 | G | P | G | G | G | G |
| 34 | G | P | G | G | G | G |
| 35 | G | P | G | G | G | G |
| 36 | G | P | G | G | G | G |
| 37 | G | P | G | G | G | G |
| 38 | G | P | G | G | G | G |
| 39 | G | P | G | G | G | G |
| 40 | G | P | G | G | G | G |
| 41 | G | P | G | G | G | G |
| 42 | G | P | G | G | G | G |
| 43 | G | P | G | G | G | G |
| 44 | G | P | G | G | G | G |
| 45 | G | P | G | G | G | G |
| 46 | G | P | G | G | G | G |
| 47 | G | G | G | G | G | F |
| 48 | G | G | G | G | G | F |
| 49 | G | G | G | G | G | F |
| 50 | G | G | G | G | G | F |
| 51 | G | G | G | G | G | F |
| 52 | G | G | G | G | G | F |
| 53 | G | G | G | G | G | F |
| 54 | G | G | G | G | G | F |
| 55 | Ex | Ex | G | P | P | F |
| 56 | Ex | Ex | G | P | P | F |
| 57 | Ex | Ex | G | P | P | F |
| 58 | Ex | Ex | G | P | P | F |
| 59 | Ex | Ex | G | P | P | F |
| 60 | Ex | Ex | G | P | P | F |
| 61 | Ex | Ex | G | P | P | F |

TABLE 12-3

| No. | Quality characteristics | | | | | |
|---|---|---|---|---|---|---|
| | Corrosion resistance (SST) | White rust resistance in environment in contact with flowing water | Corrosion resistance in dew condensation environment | Erichsen worked portion corrosion resistance | Blackening resistance | External appearance |
| 62 | Ex | Ex | G | P | P | F |
| 63 | G | P | G | G | G | G |
| 64 | G | P | G | G | G | G |
| 65 | G | P | G | G | G | G |
| 66 | G | P | G | G | G | G |
| 67 | G | P | G | G | G | G |
| 68 | G | P | G | G | G | G |
| 79 | G | P | G | G | G | G |
| 80 | G | P | G | G | G | G |
| 81 | G | P | G | G | G | F |
| 82 | G | P | G | G | G | F |
| 83 | G | P | G | G | G | F |
| 84 | G | P | G | G | G | F |
| 85 | G | P | G | G | G | F |
| 86 | G | P | G | G | G | F |
| 87 | G | P | G | G | G | F |
| 88 | G | P | G | G | G | F |
| 89 | G | P | G | G | G | G |
| 90 | G | P | G | G | G | G |
| 91 | G | P | G | G | G | G |
| 92 | G | P | G | G | G | G |
| 93 | G | P | G | G | G | G |
| 94 | G | P | G | G | G | G |

TABLE 12-3-continued

| No. | Quality characteristics | | | | | |
|---|---|---|---|---|---|---|
| | Corrosion resistance (SST) | White rust resistance in environment in contact with flowing water | Corrosion resistance in dew condensation environment | Erichsen worked portion corrosion resistance | Blackening resistance | External appearance |
| 95 | G | P | G | G | G | G |
| 96 | G | P | G | G | G | G |
| 97 | G | G | G | G | G | F |
| 98 | G | G | G | G | G | F |
| 99 | G | G | G | G | G | F |
| 100 | G | G | G | G | G | F |
| 101 | G | G | G | G | G | F |
| 102 | G | G | G | G | G | F |
| 103 | G | G | G | G | G | F |

TABLE 12-4

| No. | Quality characteristics | | | | | |
|---|---|---|---|---|---|---|
| | Corrosion resistance (SST) | White rust resistance in environment in contact with flowing water | Corrosion resistance in dew condensation environment | Erichsen worked portion corrosion resistance | Blackening resistance | External appearance |
| 104 | G | G | G | G | G | F |
| 105 | G | P | G | G | G | G |
| 106 | G | P | G | G | G | G |
| 107 | G | P | G | G | G | G |
| 108 | G | P | G | G | G | G |
| 109 | G | Ex | P | G | P | G |
| 110 | G | Ex | P | G | P | G |
| 111 | G | Ex | P | G | P | G |
| 112 | G | Ex | P | G | P | G |
| 113 | G | P | G | G | G | G |
| 114 | G | P | G | G | G | G |
| 115 | G | P | G | G | G | G |
| 116 | G | P | G | G | G | G |
| 107 | G | Ex | G | G | P | G |
| 108 | G | Ex | G | G | P | G |
| 109 | G | Ex | G | P | P | G |
| 110 | G | Ex | G | P | P | G |
| 105 | G | P | G | G | G | G |
| 106 | G | P | G | G | G | G |
| 107 | G | P | G | G | G | G |
| 108 | G | P | G | G | G | G |
| 115 | G | P | P | G | G | G |
| 116 | G | P | P | G | G | G |
| 117 | G | P | P | G | G | G |
| 118 | G | P | P | G | G | G |
| 119 | G | P | G | G | G | G |
| 120 | G | P | G | G | G | G |

As can be seen from Tables 1 to 12-4, in examples (Examples Nos. 1 to 30, Nos. 47 to 54, and Nos. 97 to 104 of the present invention) in which the predetermined plated layer and the chemical conversion coating were provided on the steel material, the chemical conversion coating had the F—Mg concentrated layer in which the Mg concentration was 1.50 mass % or more and 40.00 mass % or less and the F concentration was 0.50 mass % or more and 5.00 mass % or less in a region in contact with the interface between the chemical conversion coating and the plated layer, and the average Mg concentration was less than 0.50 mass % and the average F concentration was less than 0.50 mass % in a region excluding the F—Mg concentrated layer in the chemical conversion coating, the blackening resistance was good, and generation of white rust was suppressed in both the environment in contact with flowing water and the environment in which dew condensation occurred.

However, among these, Nos. 1 to 30 were excellent in external appearance, but Nos. 47 to 54 and Nos. 97 to 104 were inferior in external appearance of the plated layer of the plated steel sheet, and thus were inferior in external appearance of the surface-treated steel sheet.

On the other hand, in Comparative Examples Nos. 31 to 46, Nos. 55 to 86, and Nos. 95 to 120, a predetermined F—Mg concentrated layer was not obtained, and white rust was generated in one or both of the environment of poor external appearance and blackening resistance and/or in contact with flowing water and the environment in which dew condensation occurred.

FIELD OF INDUSTRIAL APPLICATION

According to the present invention, it is possible to provide a surface-treated steel sheet capable of suppressing generation of white rust in both an environment where the steel sheet is in contact with flowing water and an environment where dew condensation occurs. This surface-treated steel sheet is applicable to a steel sheet for civil engineering and construction applications used in an environment where a steel material comes into contact with flowing water or in an environment where dew condensation occurs, and has high industrial applicability.

BRIEF DESCRIPTION OF THE REFERENCE SYMBOLS

1 Surface-treated steel sheet
11 Base steel sheet
12 Plated layer
13 Chemical conversion coating
14 F—Mg concentrated layer

What is claimed is:

1. A surface-treated steel sheet, comprising:
a base steel sheet;
a plated layer formed on the base steel sheet and containing 50 mass % or more of Zn and 0.3 mass % or more of Mg; and
a chemical conversion coating formed on the plated layer, wherein the chemical conversion coating contains a silicon compound, P and F, and Mg,
an average Si concentration of the chemical conversion coating is 10 mass % or more,
the chemical conversion coating includes an F—Mg concentrated layer having an Mg concentration of 1.50 mass % or more and 40.00 mass % or less and an F concentration of 0.50 mass % or more and 5.00 mass % or less in a region in contact with an interface between the chemical conversion coating and the plated layer,
a thickness of the F—Mg concentrated layer is 1.0 nm or more, and
an average Mg concentration is less than 0.50 mass % and an average F concentration is less than 0.50 mass % in a region of the chemical conversion coating excluding the F—Mg concentrated layer.

2. The surface-treated steel sheet according to claim 1, wherein
the thickness of the F—Mg concentrated layer is 5.0 nm or more and 100.0 nm or less in the chemical conversion coating.

3. The surface-treated steel sheet according to claim 1, wherein
a chemical composition of the plated layer includes, in terms of mass %,
Al: 4.0% or more and less than 25.0%,
Mg: 0.3% or more and less than 12.5%,
Sn: 0% or more and 20% or less,
Bi: 0% or more and less than 5.0%,
In: 0% or more and less than 2.0%,
Ca: 0% or more and 3.0% or less,
Y: 0% or more and 0.5% or less,
La: 0% or more and less than 0.5%,
Ce: 0% or more and less than 0.5%,
Si: 0% or more and less than 2.5%,
Cr: 0% or more and less than 0.25%,
Ti: 0% or more and less than 0.25%,
Ni: 0% or more and less than 0.25%,
Co: 0% or more and less than 0.25%,
V: 0% or more and less than 0.25%,
Nb: 0% or more and less than 0.25%,
Cu: 0% or more and less than 0.25%,
Mn: 0% or more and less than 0.25%,
Fe: 0% or more and 5.0% or less,
Sr: 0% or more and less than 0.5%,
Sb: 0% or more and less than 0.5%,
Pb: 0% or more and less than 0.5%,
B: 0% or more and less than 0.5%, and
the remainder: Zn and an impurity.

4. The surface-treated steel sheet according to claim 2, wherein
a chemical composition of the plated layer includes, in terms of mass %,
Al: 4.0% or more and less than 25.0%,
Mg: 0.3% or more and less than 12.5%,
Sn: 0% or more and 20% or less,
Bi: 0% or more and less than 5.0%,
In: 0% or more and less than 2.0%,
Ca: 0% or more and 3.0% or less,
Y: 0% or more and 0.5% or less,
La: 0% or more and less than 0.5%,
Ce: 0% or more and less than 0.5%,
Si: 0% or more and less than 2.5%,
Cr: 0% or more and less than 0.25%,
Ti: 0% or more and less than 0.25%,
Ni: 0% or more and less than 0.25%,
Co: 0% or more and less than 0.25%,
V: 0% or more and less than 0.25%,
Nb: 0% or more and less than 0.25%,
Cu: 0% or more and less than 0.25%,
Mn: 0% or more and less than 0.25%,
Fe: 0% or more and 5.0% or less,
Sr: 0% or more and less than 0.5%,
Sb: 0% or more and less than 0.5%,
Pb: 0% or more and less than 0.5%,
B: 0% or more and less than 0.5%, and
the remainder: Zn and an impurity.

* * * * *